US010570843B2

(12) United States Patent
Yoda et al.

(10) Patent No.: US 10,570,843 B2
(45) Date of Patent: Feb. 25, 2020

(54) EXHAUST PURIFICATION SYSTEM OF INTERNAL COMBUSTION ENGINE

(71) Applicant: Toyota Jidosha Kabushiki Kaisha, Toyota-shi, Aichi-ken (JP)

(72) Inventors: Kimikazu Yoda, Susono (JP); Keiichiro Aoki, Shizuoka-ken (JP); Go Hayashita, Chigasaki (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/922,187

(22) Filed: Mar. 15, 2018

(65) Prior Publication Data

US 2018/0283304 A1 Oct. 4, 2018

(30) Foreign Application Priority Data

Apr. 4, 2017 (JP) ..... 2017-074738

(51) Int. Cl.
*F02D 41/14* (2006.01)
*F01N 3/20* (2006.01)
(Continued)

(52) U.S. Cl.
CPC ..... *F02D 41/1475* (2013.01); *F01N 3/20* (2013.01); *F02D 41/068* (2013.01); *F02D 41/1445* (2013.01); *F02D 41/1446* (2013.01); *F02D 41/1447* (2013.01); *F02D 41/1454* (2013.01); *F02D 41/1456* (2013.01); *F02D 41/1463* (2013.01); *F02M 31/042* (2013.01); *F02M 31/10* (2013.01); *F01N 2430/06* (2013.01); *F01N 2560/021* (2013.01); *F01N 2560/025* (2013.01); *F01N 2560/026* (2013.01);
(Continued)

(58) Field of Classification Search
CPC combination set(s) only.
See application file for complete search history.

(56) References Cited

U.S. PATENT DOCUMENTS 5,315,823 A 5/1994 Nishikawa et al.
6,694,724 B2 * 2/2004 Tanaka ..... B01D 53/9431 60/274
(Continued)

FOREIGN PATENT DOCUMENTS

DE 100 62 289 A1 7/2002
EP 1 559 892 A1 8/2005
(Continued)

*Primary Examiner* — Binh Q Tran
(74) *Attorney, Agent, or Firm* — Dinsmore & Shohl LLP

(57) ABSTRACT

The exhaust purification system of an internal combustion engine comprises: a catalyst arranged in an exhaust passage of the internal combustion engine and able to store oxygen; an ammonia detection device arranged in the exhaust passage at a downstream side of the catalyst in a direction of flow of exhaust; and an air-fuel ratio control part configured to control an air-fuel ratio of inflowing exhaust gas flowing into the catalyst to a target air-fuel ratio. The air-fuel ratio control part is configured to perform rich control making the target air-fuel ratio richer than a stoichiometric air-fuel ratio, and make the target air-fuel ratio leaner than the stoichiometric air-fuel ratio when an output value of the ammonia detection device rises to a reference value in the rich control.

6 Claims, 17 Drawing Sheets

(51) Int. Cl.
*F02D 41/06* (2006.01)
*F02M 31/10* (2006.01)
*F02M 31/04* (2006.01)

(52) U.S. Cl.
CPC .. *F01N 2560/06* (2013.01); *F01N 2900/1402* (2013.01); *F01N 2900/1404* (2013.01); *F02D 2041/1468* (2013.01); *F02D 2200/0802* (2013.01); *F02D 2200/0804* (2013.01)

(56) References Cited

U.S. PATENT DOCUMENTS

| | | | | |
|---|---|---|---|---|
| 6,698,188 | B2 * | 3/2004 | Irisawa | F01N 3/0807 60/276 |
| 8,249,793 | B2 * | 8/2012 | Miyashita | F02D 41/1441 123/674 |
| 8,769,934 | B2 * | 7/2014 | Sakurai | F01N 3/0814 60/277 |
| 9,765,666 | B2 * | 9/2017 | Smith | F01N 3/2073 |
| 10,107,163 | B2 * | 10/2018 | Shinoda | F01N 3/2073 |
| 2002/0069640 | A1 | 6/2002 | Irisawa et al. | |
| 2005/0166579 | A1 | 8/2005 | Suzuki et al. | |
| 2009/0199543 | A1 * | 8/2009 | Sawada | F01N 3/0814 60/276 |

FOREIGN PATENT DOCUMENTS

| | | | |
|---|---|---|---|
| JP | 2002-276419 | A | 9/2002 |
| JP | 2005-214098 | A | 8/2005 |
| JP | 2008175173 | A | 7/2008 |

* cited by examiner

EXHAUST PURIFICATION SYSTEM OF INTERNAL COMBUSTION ENGINE

CROSS-REFERENCE TO RELATED APPLICATIONS

This application claims priority to Japanese Patent Application No. 2017-074738 filed on Apr. 4, 2017, the entire contents of which are incorporated herein by reference.

TECHNICAL FIELD

The present disclosure relates to an exhaust purification system of an internal combustion engine.

BACKGROUND ART

It has been known in the past to arrange a catalyst and exhaust sensor (air-fuel ratio sensor, $NO_X$ sensor, etc.,) in an exhaust passage of an internal combustion engine and control an air-fuel ratio of exhaust gas flowing into the catalyst based on an output of the exhaust sensor so as to keep the exhaust emission from deteriorating. For example, in the internal combustion engine described in PLT 1, a non-lean operation where the air-fuel ratio is the stoichiometric air-fuel ratio or rich is performed, and the rich degree of the air-fuel ratio is made smaller when the output value of the $NO_X$ sensor reaches a predetermined value or more so as to keep down the amount of discharge of the ammonia produced at the catalyst.

CITATION LIST

Patent Literature

PLT 1: Japanese Patent Publication No. 2008-175173A

SUMMARY

Technical Problem

However, when the air-fuel ratio is made rich, the amount of unburned gas (HC, CO, etc.) discharged from the combustion chambers of the internal combustion engine to the exhaust passage increases. For this reason, if the state in which the air-fuel ratio is made rich is maintained for a long time, unburned gas flows out from the catalyst and the exhaust emission deteriorates.

As opposed to this, PLT 1 does not allude at all to the fact that the amount of discharge of unburned gas increases when the air-fuel ratio is made rich and to the control for keeping down the amount of unburned gas flowing out from the catalyst. In actuality, in the internal combustion engine described in PLT 1, the rich degree of the air-fuel ratio is made smaller so as to keep down the amount of discharge of ammonia in a non-lean operation when the output value of the $NO_X$ sensor reaches a predetermined value or more, but the non-lean operation is continued. For this reason, unburned gas flows out from the catalyst and the exhaust emission deteriorates.

Therefore, an object of the present disclosure is to provide an exhaust purification system of an internal combustion engine able to suppress an amount of unburned gas flowing out from a catalyst when an air-fuel ratio is made rich.

Solution to Problem

The summary of the present disclosure is as follows.

(1) An exhaust purification system of an internal combustion engine comprising: a catalyst arranged in an exhaust passage of the internal combustion engine and able to store oxygen; an ammonia detection device arranged in the exhaust passage at a downstream side of the catalyst in a direction of flow of exhaust; and an air-fuel ratio control part configured to control an air-fuel ratio of inflowing exhaust gas flowing into the catalyst to a target air-fuel ratio, wherein the air-fuel ratio control part is configured to perform rich control making the target air-fuel ratio richer than a stoichiometric air-fuel ratio, and make the target air-fuel ratio leaner than the stoichiometric air-fuel ratio when an output value of the ammonia detection device rises to a reference value in the rich control.

(2) The exhaust purification system of an internal combustion engine described in above (1), further comprising an air-fuel ratio detection device arranged in the exhaust passage at the downstream side of the catalyst in the direction of flow of exhaust, wherein in the rich control, if an air-fuel ratio detected by the air-fuel ratio detection device falls to a rich judged air-fuel ratio richer than the stoichiometric air-fuel ratio before the output value of the ammonia detection device rises to the reference value, the air-fuel ratio control part is configured to make the target air-fuel ratio leaner than the stoichiometric air-fuel ratio when the air-fuel ratio detected by the air-fuel ratio detection device falls to the rich judged air-fuel ratio.

(3) The exhaust purification system of an internal combustion engine described in above (1) or (2), wherein the air-fuel ratio control part is configured to alternately perform lean control making the target air-fuel ratio leaner than the stoichiometric air-fuel ratio and the rich control.

(4) The exhaust purification system of an internal combustion engine described in any one of above (1) to (3), further comprising a temperature detection part configured to detect or estimate a temperature of the catalyst or a temperature of exhaust gas flowing out from the catalyst, wherein the air-fuel ratio control part is configured to make the reference value smaller the higher the temperature detected or estimated by the temperature detection part.

(5) The exhaust purification system of an internal combustion engine described in any one of above (1) to (3), further comprising a temperature detection part configured to detect or estimate a temperature of the catalyst or a temperature of exhaust gas flowing out from the catalyst, wherein the air-fuel ratio control part is configured to make a rich degree of the target air-fuel ratio in the rich control smaller the higher the temperature detected or estimated by the temperature detection part.

(6) The exhaust purification system of an internal combustion engine described in any one of above (1) to (5), wherein the ammonia detection device is a sensor cell of an $NO_X$ sensor.

Advantageous Effects

According to the present disclosure, there is provided an exhaust purification system of an internal combustion engine able to suppress an amount of unburned gas flowing out from a catalyst when an air-fuel ratio is made rich.

DETAILED DESCRIPTION

Figure 1:
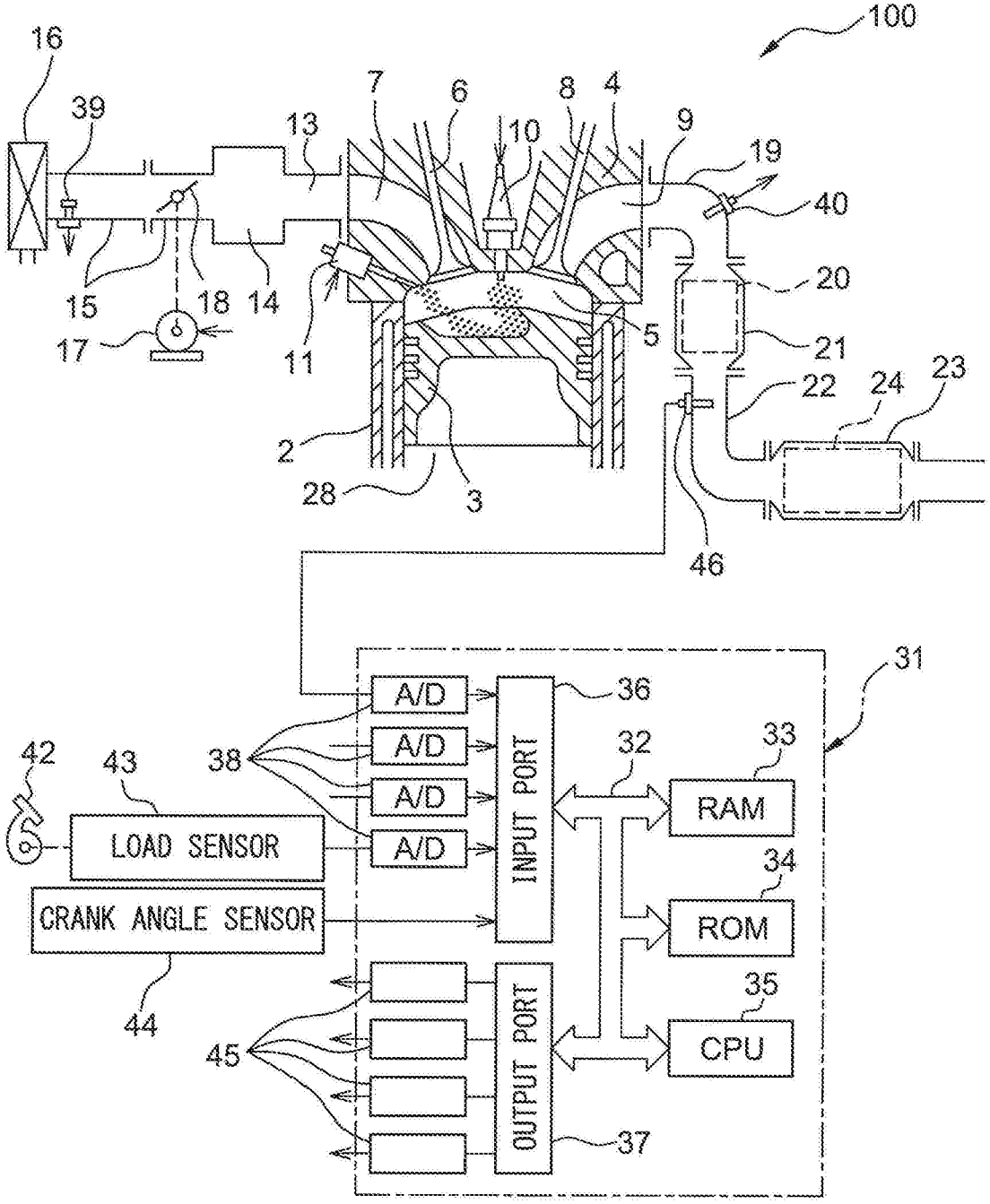
FIG. 1 is a view schematically showing an internal combustion engine in which an exhaust purification system of an internal combustion engine according to a first embodiment of the present disclosure is provided.

Below, referring to the figures, embodiments of the present disclosure will be explained in detail. Note that, in the following explanation, similar components are assigned the same reference numerals.

First Embodiment

First, referring to FIG. 1 to FIG. 9, a first embodiment of the present disclosure will be explained.

Explanation of Internal Combustion Engine Overall

FIG. 1 is a view schematically showing an internal combustion engine 100 provided with an exhaust purification system of an internal combustion engine according to a first embodiment of the present disclosure. The internal combustion engine 100 shown in FIG. 1 is a spark ignition type internal combustion engine (gasoline engine). The internal combustion engine 100 is mounted in a vehicle.

Referring to FIG. 1, 2 indicates a cylinder block 2, a piston 3 which reciprocates inside the cylinder block 2, a cylinder head 4 which is fastened to the cylinder block 2, a combustion chamber 5 which is formed between the piston 3 and the cylinder head 4, an intake valve 6, an intake port 7, an exhaust valve 8, and an exhaust port 9. The intake valve 6 opens and closes the intake port 7, while the exhaust valve 8 opens and closes the exhaust port 9. The cylinder block 2 defines cylinders 28.

As shown in FIG. 1, at the center part of the inside wall surface of the cylinder head 4, a spark plug 10 is arranged. A fuel injector 11 is arranged around the inside wall surface of the cylinder head 4. The spark plug 10 is configured to cause generation of a spark in accordance with an ignition signal. Further, the fuel injector 11 injects a predetermined amount of fuel into the combustion chamber 5 in accordance with an injection signal. In the present embodiment, as the fuel, gasoline with a stoichiometric air-fuel ratio of 14.6 is used.

The intake port 7 in each cylinder is connected through a corresponding intake runner 13 to a surge tank 14. The surge tank 14 is connected through an intake pipe 15 to an air cleaner 16. The intake port 7, intake runner 13, surge tank 14, intake pipe 15, etc., form an intake passage which leads air to the combustion chamber 5. Further, inside the intake pipe 15, a throttle valve 18 which is driven by a throttle valve drive actuator 17 is arranged. The throttle valve 18 can be turned by the throttle valve drive actuator 17 to thereby change the opening area of the intake passage.

On the other hand, the exhaust port 9 in each cylinder is connected to an exhaust manifold 19. The exhaust manifold 19 has a plurality of runners which are connected to the exhaust ports 9 and a header at which these runners are collected. The header of the exhaust manifold 19 is connected to an upstream side casing 21 which has an upstream side catalyst 20 built into it. The upstream side casing 21 is connected to a downstream side casing 23 which has a downstream side catalyst 24 built into it via an exhaust pipe 22. The exhaust port 9, exhaust manifold 19, upstream side casing 21, exhaust pipe 22, downstream side casing 23, etc., form an exhaust passage which discharges exhaust gas produced due to combustion of the air-fuel mixture in the combustion chamber 5.

Various control routines of the internal combustion engine are performed by an electronic control unit (ECU) 31. The ECU 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 detecting the flow rate of air which flows through the intake pipe 15 is arranged. The output of the air flow meter 39 is input through a corresponding AD converter 38 to the input port 36.

Further, at the header of the exhaust manifold 19, i.e., a upstream side of the upstream side catalyst 20 in the direction of flow of exhaust, an upstream side air-fuel ratio sensor 40 is arranged which detects the air-fuel ratio of the exhaust gas which flows through the inside of the exhaust manifold 19 (that is, the exhaust gas which flows into the upstream side catalyst 20). The output of the upstream side air-fuel ratio sensor 40 is input through the corresponding AD converter 38 to the input port 36.

Further, inside the exhaust pipe 22, that is, at the downstream side of the upstream side catalyst 20 in the direction of flow of exhaust, an ammonia sensor ($NH_3$ sensor) 46 for detecting the ammonia concentration ($NH_3$ concentration) in the exhaust gas flowing through the inside of the exhaust pipe 22 (that is, exhaust gas flowing out from the upstream side catalyst 20) is arranged. The ammonia sensor 46 is arranged between the upstream side catalyst 20 and downstream side catalyst 24 in the direction of flow of exhaust. The output of the ammonia sensor 46 is input through a corresponding AD converter 38 to the input port 36.

Further, an accelerator pedal 42 is connected to a load sensor 43 generating an output voltage proportional to the amount of depression of the accelerator pedal 42. The output voltage of the load sensor 43 is input through a corresponding AD converter 38 to the input port 36. A crank angle sensor 44 generates an output pulse every time the crankshaft rotates, for example, by 15 degrees. This output pulse is input to the input port 36. In the CPU 35, the engine speed is calculated from the output pulse of the crank angle sensor 44. On the other hand, the output port 37 is connected through corresponding drive circuits 45 to the spark plugs 10, fuel injectors 11, and the throttle valve drive actuator 17.

Note that, the above-mentioned internal combustion engine 100 is a nonsupercharged internal combustion engine fueled by gasoline, but the configuration of the internal combustion engine 100 is not limited to the above configuration. Therefore, the cylinder array, mode of injection of fuel, configuration of the intake and exhaust systems, configuration of the valve operating mechanism, presence of any supercharger, and other specific parts of the configuration of the internal combustion engine 100 may differ from the configuration shown in FIG. 1. For example, the fuel injectors 11 may be arranged to inject fuel into the intake ports 7. Further, the internal combustion engine 100 may be a compression ignition type internal combustion engine (diesel engine).

Explanation of Catalyst

The upstream side catalyst 20 and downstream side catalyst 24 arranged in the exhaust passage have similar configurations. The catalysts 20 and 24 have oxygen storage abilities. The catalysts 20 and 24 are for example three-way catalysts. Specifically, the catalysts 20 and 24 are comprised of carriers comprised of ceramic on which a precious metal having a catalytic action (for example, platinum (Pt)) and a substance having an oxygen storage ability (for example, ceria ($CeO_2$)) are carried. The catalysts 20 and 24 can simultaneously remove unburned gas (HC, CO, etc.) and nitrogen oxides ($NO_X$) if reaching a predetermined activation temperature.

The catalysts 20 and 24 store the oxygen in the exhaust gas when the air-fuel ratio of the exhaust gas flowing into the catalysts 20 and 24 is an air-fuel ratio leaner than the stoichiometric air-fuel ratio (below, referred to as a "lean air-fuel ratio"). On the other hand, the catalysts 20 and 24 release the oxygen stored in the catalysts 20 and 24 when the air-fuel ratio of the inflowing exhaust gas is an air-fuel ratio richer than the stoichiometric air-fuel ratio (below, referred to as a "rich air-fuel ratio").

Figure 2A:
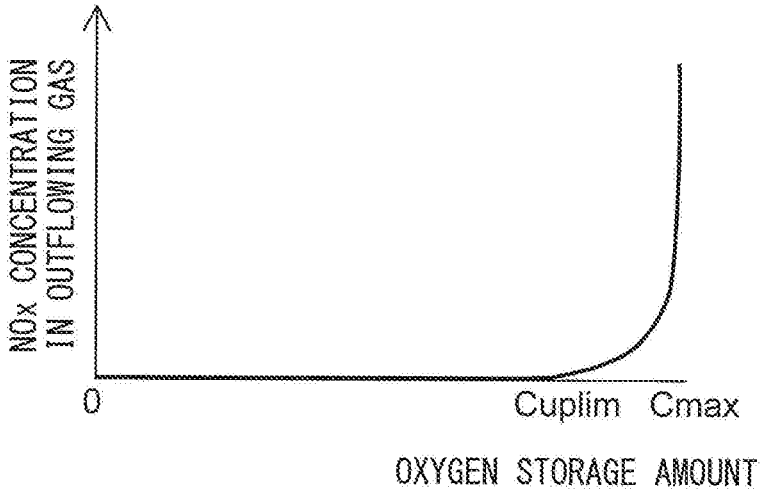
FIG. 2A is a view showing a relationship between an oxygen storage amount of a catalyst and an $NO_X$ concentration in exhaust gas flowing out from a catalyst.

The catalysts 20 and 24 have catalytic actions and oxygen storage abilities, so have the actions of removing the $NO_X$ and unburned gas according to the oxygen storage amounts. If the air-fuel ratio of the exhaust gas flowing into the catalysts 20 and 24 is a lean air-fuel ratio, as shown in FIG. 2A, when the oxygen storage amounts are small, the oxygen in the exhaust gas is stored in the catalysts 20 and 24 and the $NO_X$ in the exhaust gas is removed by reduction. Further, if the oxygen storage amounts become large, the concentrations of oxygen and $NO_X$ in the exhaust gas flowing out from the catalysts 20 and 24 rapidly rise at a certain storage amount near the maximum storable oxygen amounts Cmax (Cuplim in the figure).

Figure 2B:
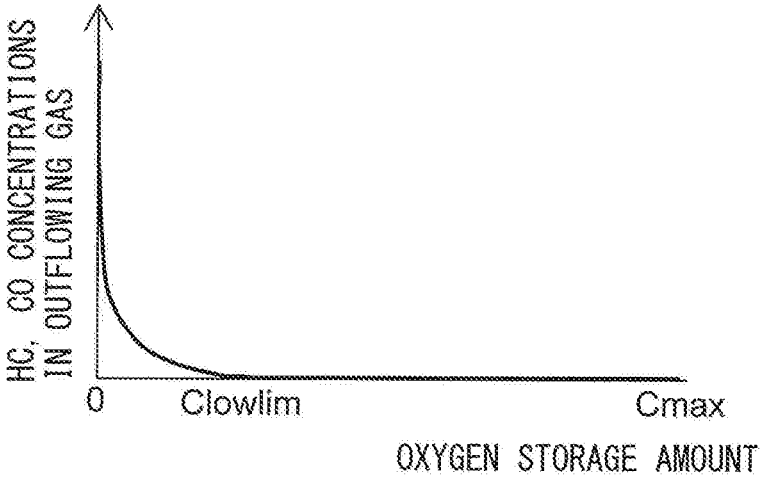
FIG. 2B is a view showing a relationship between an oxygen storage amount of a catalyst and HC, CO concentrations in exhaust gas flowing out from a catalyst.

On the other hand, if the air-fuel ratio of the exhaust gas flowing into the catalysts 20 and 24 is a rich air-fuel ratio, as shown in FIG. 2B, when the oxygen storage amounts are large, the oxygen stored in the catalysts 20 and 24 is released and the unburned gas in the exhaust gas is removed by oxidation. Further, if the oxygen storage amounts become small, the concentration of unburned gas in the exhaust gas flowing out from the catalysts 20 and 24 rapidly rises at a certain storage amount near zero (Clowlim in figure). Therefore, the characteristics of removal of the $NO_X$ and unburned gas in the exhaust gas change in accordance with the air-fuel ratio of the exhaust gas flowing into the catalysts 20 and 24 and oxygen storage amounts of the catalysts 20 and 24.

Note that, as long as the catalysts 20 and 24 have catalytic actions and oxygen storage abilities, they may be catalysts different from three-way catalysts. Further, the downstream side catalyst 24 may be omitted.

Figure 3:
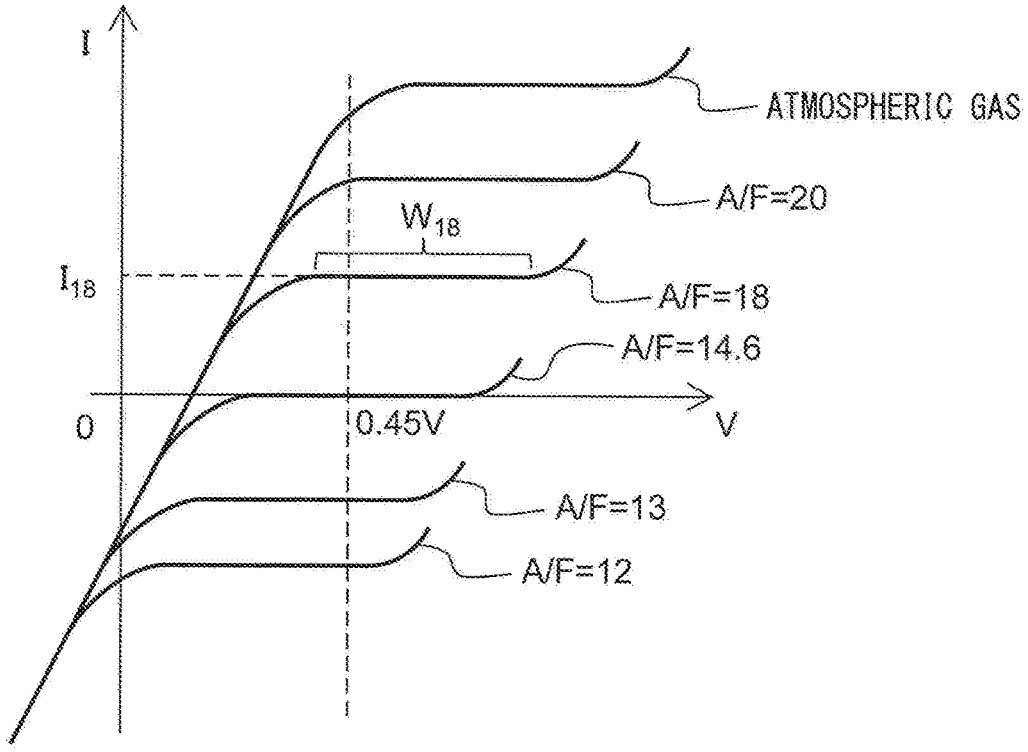
FIG. 3 is a view showing a relationship between a sensor applied voltage and output current at different exhaust air-fuel ratios.
Figure 4:
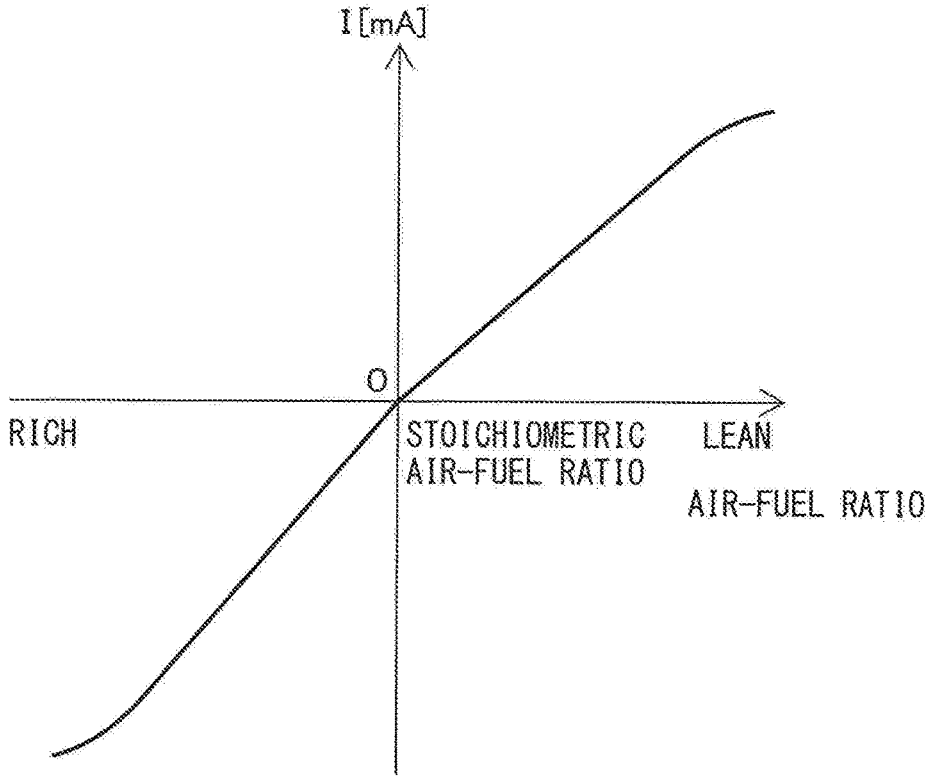
FIG. 4 is a view showing a relationship between an exhaust air-fuel ratio and output current when setting a sensor applied voltage constant.

Output Characteristics of Air-Fuel Ratio Sensor Next, referring to FIG. 3 and FIG. 4, the output characteristic of the upstream side air-fuel ratio sensor 40 will be explained. FIG. 3 is a view showing the voltage-current (V-I) characteristic of the upstream side air-fuel ratio sensor 40. FIG. 4 is a graph showing the relationship between the air-fuel ratio of exhaust gas supplied to the upstream side air-fuel ratio sensor 40 (below, referred to as the "exhaust air-fuel ratio") and the output current I of the upstream side air-fuel ratio sensor 40 when making the applied voltage constant.

As will be understood from FIG. 3, the output current I of the upstream side air-fuel ratio sensor 40 becomes larger the higher the exhaust air-fuel ratio (the leaner it is). Further, at the V-I lines at the different exhaust air-fuel ratios, there are regions substantially parallel to the V-axis, that is, regions where the output currents do not change much at all even if the applied voltages change. These voltage regions are called "limit current regions". The currents at this time are called the "limit currents". In FIG. 3, the limit current region and limit current when the exhaust air-fuel ratio is 18 are respectively shown by $W_{18}$ and $I_{18}$. Therefore, the upstream side air-fuel ratio sensor 40 is a limit current type air-fuel ratio sensor.

FIG. 4 is a view showing the relationship between the exhaust air-fuel ratio and the output current I when making the applied voltage constant at 0.45V or so. As will be understood from FIG. 4, at the upstream side air-fuel ratio sensor 40, the higher the exhaust air-fuel ratios (that is, the leaner they are), the larger the output current I of the upstream side air-fuel ratio sensor 40. That is, the output currents I change linearly (proportionally) with respect to the exhaust air-fuel ratio. In addition, the upstream side air-fuel ratio sensor 40 is configured so that the output current I becomes zero when the exhaust air-fuel ratio is the stoichiometric air-fuel ratio.

Accordingly, it is possible to detect the air-fuel ratio of the exhaust gas supplied to the upstream side air-fuel ratio sensor 40 by detecting the output of the upstream side air-fuel ratio sensor 40 in the state where a predetermined voltage is applied to the upstream side air-fuel ratio sensor 40. In the present embodiment, the upstream side air-fuel ratio sensor 40 can be used to detect the air-fuel ratio of the exhaust gas flowing into the upstream side catalyst 20 (below, referred to as the "inflowing exhaust gas").

Figure 5:
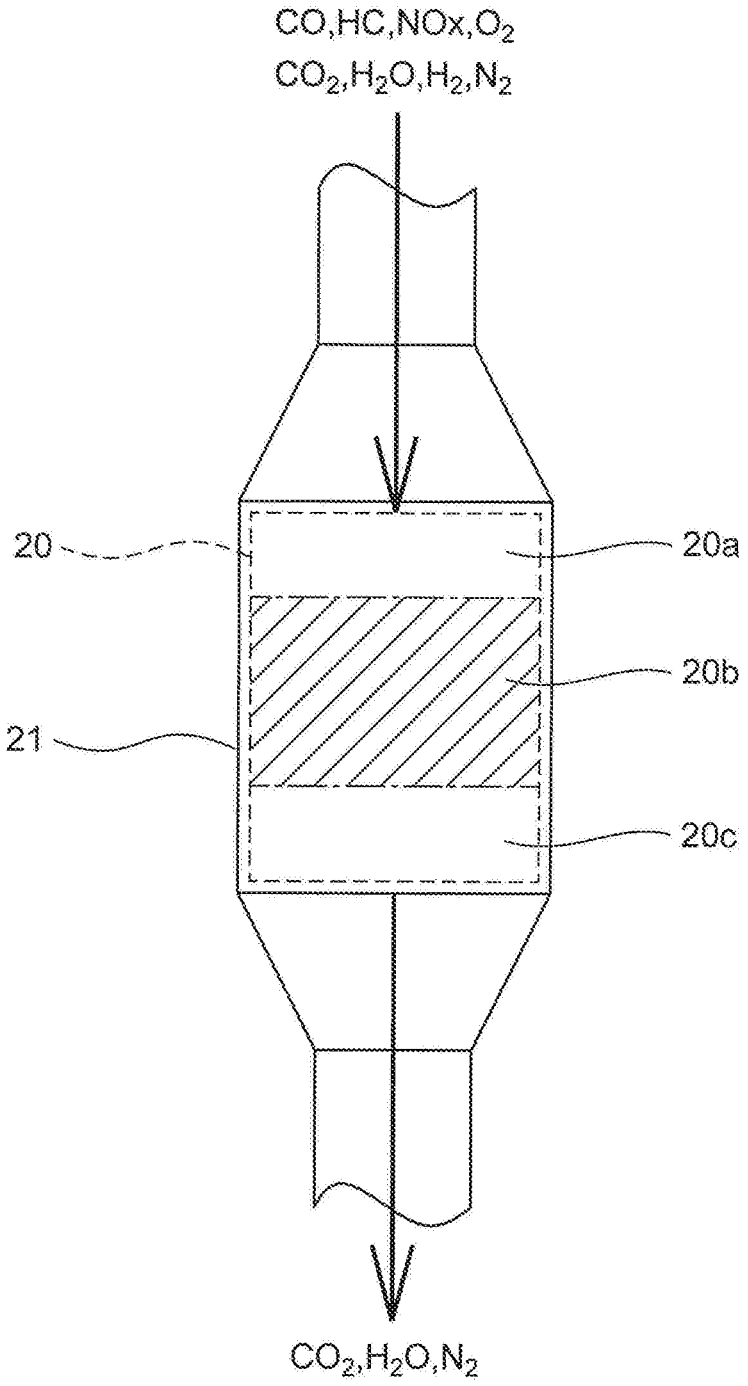
FIG. 5 is a view schematically showing an upstream side catalyst in the state where an oxygen storage amount is small.

Exhaust Purification Mechanism of Catalyst Below, the mechanism by which exhaust gas is purified at the upstream side catalyst 20 when exhaust gas of a rich air-fuel ratio flows into the upstream side catalyst 20 will be explained in detail. FIG. 5 is a view schematically showing an upstream side catalyst 20 in the state where the oxygen storage amount is small. FIG. 5 shows the direction of flow of exhaust by arrows. In this example, exhaust gas of a rich air-fuel ratio continues to flow into the upstream side catalyst 20. If exhaust gas of a rich air-fuel ratio flows into the upstream side catalyst 20, in order to remove the unburned gas, the oxygen stored in the upstream side catalyst 20 is released. The oxygen stored in the upstream side catalyst 20 is successively released from the upstream side of the upstream side catalyst 20 in the direction of flow of exhaust. For this reason, in the example of FIG. 5, an oxygen storage region 20*c* where oxygen is stored remains only at the downstream side of the upstream side catalyst 20.

Exhaust gas of a rich air-fuel ratio mainly contains carbon monoxide (CO), hydrocarbon (HC), nitrogen oxides ($NO_X$), oxygen ($O_2$), carbon dioxide ($CO_2$), water ($H_2O$), hydrogen ($H_2$), and nitrogen ($N_2$). The larger the rich degree of the air-fuel ratio, the higher the concentrations of hydrocarbons and carbon monoxide in the exhaust gas and the lower the concentration of $NO_X$ in the exhaust gas. If exhaust gas flows into the upstream side catalyst 20 in the state shown in FIG. 5, first, the unburned oxygen not burned in the combustion chambers 5 is consumed by the following oxygen consumption reaction (1) at the upstream side region 20*a* of the upstream side catalyst 20:

$$O_2+HC+CO+H_2 \rightarrow H_2O+CO_2 \quad (1)$$

The region between the upstream side region 20*a* and the oxygen storage region 20*c* is the rich region 20*b* where almost all of the stored oxygen is released. The rich region 20*b* is shown by hatching in FIG. 5. In the rich region 20*b*, the following water gas shift reaction (2) and steam reforming reaction (3) occur.

$$CO+H_2O \rightarrow H_2+CO_2 \quad (2)$$

$$HC+H_2O \rightarrow CO+H_2 \quad (3)$$

Further, in the rich region 20*b*, ammonia ($NH_3$) is produced by the following NO removal reaction (4):

$$NO+CO+H_2 \rightarrow N_2+H_2O+CO_2+NH_3 \quad (4)$$

Further, oxygen slightly remains in the rich region 20*b* as well. Further, hydrogen has a higher reactivity with oxygen than ammonia. For this reason, in the rich region 20*b*, the following hydrogen oxidation reaction (5) occurs whereby part of the hydrogen generated by the above water gas shift reaction (2) and steam reforming reaction (3) is oxidized.

$$H_2+O \rightarrow H_2O \quad (5)$$

On the other hand, the oxygen storage region 20*c* stores a sufficient amount of oxygen. For this reason, the hydrogen which was not oxidized in the rich region 20*b* changes to water by the above hydrogen oxidation reaction (5) in the oxygen storage region 20*c*. Further, the ammonia produced by the above NO removal reaction (4) in the rich region 20*b* is purified to water and nitrogen by the following ammonia oxidation reaction (6) in the oxygen storage region 20*c*:

$$NH_3+O \rightarrow H_2O+N_2 \quad (6)$$

Due to the above chemical reactions, the harmful substances in the exhaust gas are removed at the upstream side catalyst 20. For this reason, in the state where the upstream side catalyst 20 is storing oxygen, the exhaust gas flowing out from the upstream side catalyst 20 (below, referred to as the "outflowing exhaust gas") mainly contains carbon dioxide, water, and nitrogen.

Figure 6:
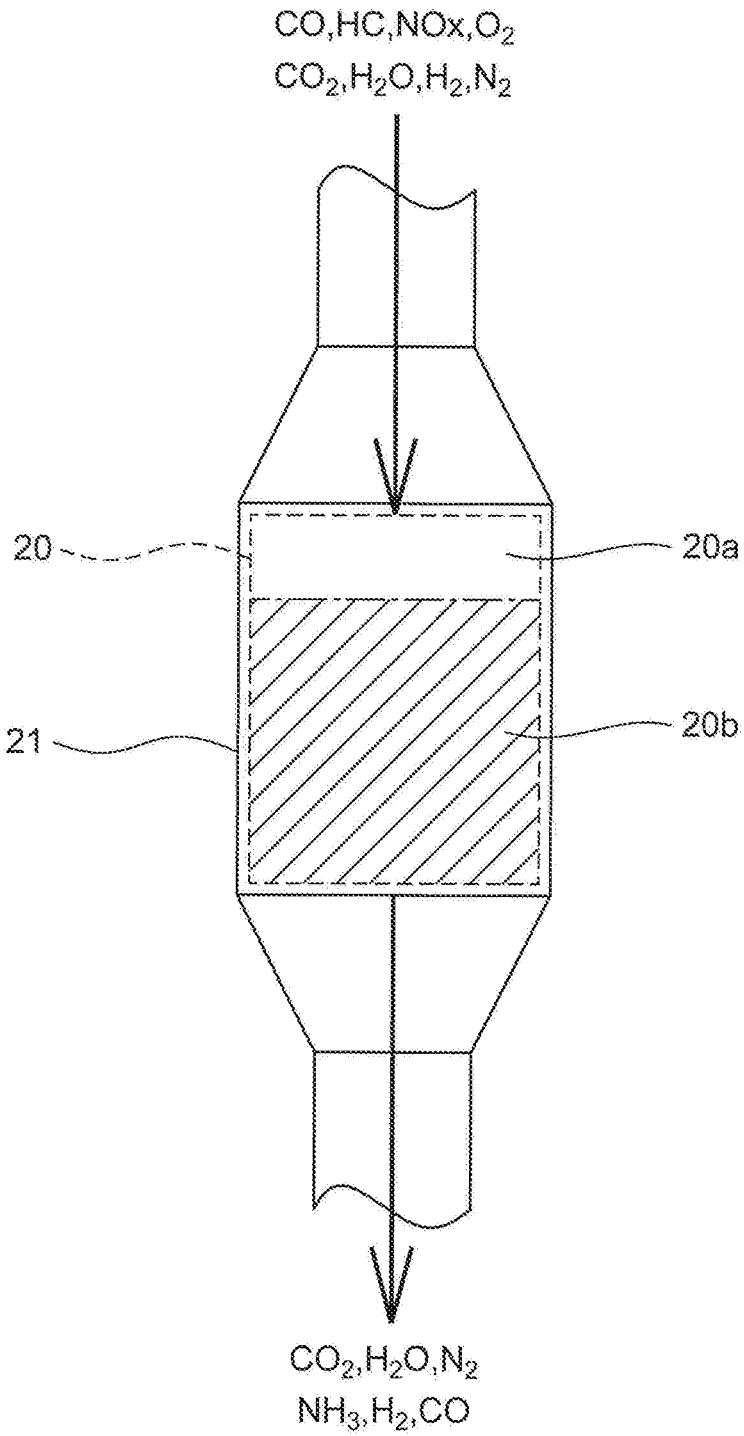
FIG. 6 is a view schematically showing an upstream side catalyst in the state where an oxygen storage amount is substantially zero.

On the other hand, FIG. 6 is a view schematically showing the upstream side catalyst 20 in a state where the oxygen storage amount is substantially zero. In the state of FIG. 5, if exhaust gas of a rich air-fuel ratio further flows into the upstream side catalyst 20, the oxygen of the oxygen storage region 20*c* is released and, as shown in FIG. 6, the oxygen storage region 20*c* changes to the rich region 20*b*. The rich region 20*b* is shown by hatching in FIG. 6.

In the example of FIG. 6 as well, exhaust gas of a rich air-fuel ratio flows into the upstream side catalyst 20. If exhaust gas of a rich air-fuel ratio flows into the upstream side catalyst 20, in the same way as the example of FIG. 5, first, at the upstream side region 20*a*, the unburned oxygen which was not burned in the combustion chambers 5 is consumed by the above oxygen consumption reaction (1). Next, at the rich region 20*b*, the above-mentioned water gas shift reaction (2), steam reforming reaction (3), NO removal reaction (4), and hydrogen oxidation reaction (5) occur.

The upstream side catalyst 20 shown in FIG. 6 does not have an oxygen storage region 20*c*. For this reason, the ammonia produced by the above NO removal reaction (4) in the rich region 20*b* flows out from the upstream side catalyst 20 without being oxidized. On the other hand, a part of the hydrogen produced by the above water gas shift reaction (2) and steam reforming reaction (3) in the rich region 20*b* is oxidized by the above hydrogen oxidation reaction (5) until the oxygen in the rich region 20*b* is depleted. For this reason, the speed of rise of the hydrogen concentration in the outflowing exhaust gas becomes slower than the speed of rise of the concentration of ammonia in the outflowing exhaust gas.

Figure 7:
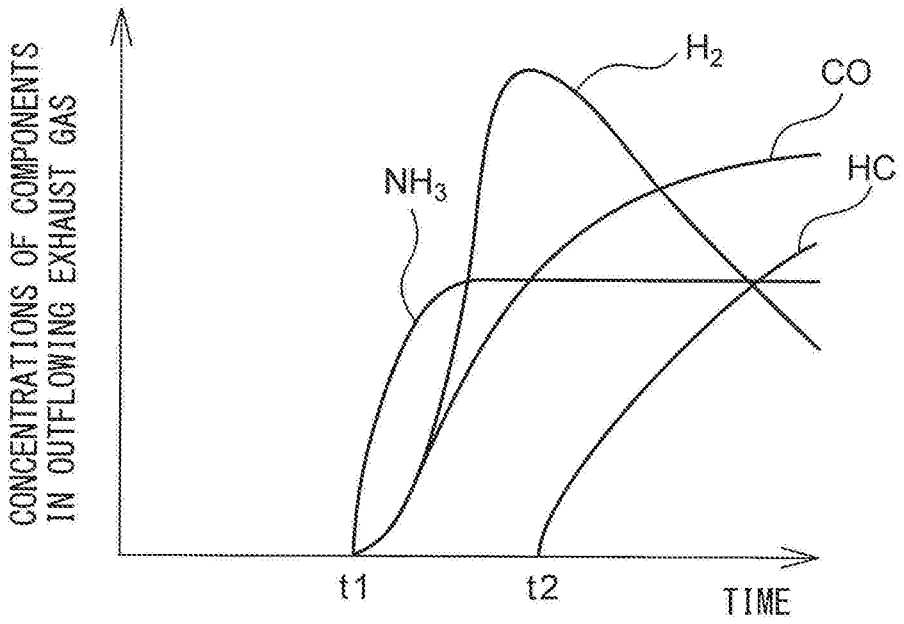
FIG. 7 is a time chart of concentrations of different components in outflowing exhaust gas when exhaust gas of a rich air-fuel ratio continues to flow into an upstream side catalyst storing oxygen.

FIG. 7 is a time chart of the concentrations of the different components in outflowing exhaust gas when exhaust gas of a rich air-fuel ratio continues to flow into the upstream side catalyst 20 in which oxygen is stored. In this example, at the time t1, due to the exhaust gas of a rich air-fuel ratio, there is no longer an oxygen storage region 20*c* of the upstream side catalyst 20, and the upstream side catalyst 20 becomes the state of FIG. 6. In the state of FIG. 6, ammonia is not oxidized, so after the time t1, the concentration of ammonia in the exhaust gas rapidly rises. On the other hand, as explained above, hydrogen has a higher reactivity with oxygen than ammonia. For this reason, hydrogen is oxidized until the oxygen in the rich region 20*b* of the upstream side catalyst 20 is depleted. As a result, after the time t1, the concentration of hydrogen in the exhaust gas rises more slowly than the ammonia concentration.

Further, after the time t1, rich poisoning of the upstream side catalyst 20 occurs and the precious metal of the upstream side catalyst 20 is covered by the rich components (HC, CO, etc.) in the exhaust gas, so the reactivity of the water gas shift reaction falls. As a result, after the time t1, carbon monoxide flows out from the upstream side catalyst 20 and the concentration of carbon monoxide in the exhaust gas gradually rises. At this time, the concentration of carbon monoxide in the exhaust gas rises more slowly than the ammonia concentration. After that, if rich poisoning of the upstream side catalyst 20 progresses and the reactivity of the water gas shift reaction further falls, the concentration of hydrogen in the exhaust gas gradually falls.

Further, if rich poisoning of the upstream side catalyst 20 progresses, the reactivity of the steam reforming reaction also falls. For this reason, after the time t2 after the time t1, hydrocarbons flow out from the upstream side catalyst 20 and the concentration of hydrocarbons in the exhaust gas gradually rises.

The ammonia sensor 46 decomposes the ammonia in the outflowing exhaust gas to detect the concentration of ammonia in the outflowing exhaust gas. For this reason, the higher the concentration of ammonia in the outflowing exhaust gas, the larger the output value of the ammonia sensor 46 becomes. As explained above, if the oxygen storage amount of the upstream side catalyst 20 approaches zero, in the outflowing exhaust gas, the concentration of ammonia rises faster than the concentration of the unburned gas (hydrocarbons, carbon monoxide, etc.). For this reason, when a change in the output of the ammonia sensor 46 is detected, the amount of unburned gas flowing out from the upstream side catalyst 20 is still small.

Exhaust Purification System of Internal Combustion Engine

Below, an exhaust purification system of an internal combustion engine 100 according to a first embodiment of the present disclosure (below, simply referred to as an "exhaust purification system") will be explained. The exhaust purification system is provided with an upstream side catalyst 20, a downstream side catalyst 24, an ammonia detection device arranged in the exhaust passage at the downstream side of the upstream side catalyst 20 in the direction of flow of exhaust, and an air-fuel ratio control part controlling the air-fuel ratio of the inflowing exhaust gas to a target air-fuel ratio. In the present embodiment, the harmful substances in the exhaust gas are basically removed at the upstream side catalyst 20. The downstream side catalyst 24 is used for auxiliary purposes. Therefore, the exhaust purification system need not be provided with the downstream side catalyst 24.

The ammonia detection device detects the concentration of ammonia in the outflowing exhaust gas. In the present embodiment, the ammonia sensor 46 functions as the ammonia detection device. Further, the ECU 31 functions as the air-fuel ratio control part.

When controlling the air-fuel ratio of the inflowing exhaust gas to the target air-fuel ratio, the air-fuel ratio control part sets the target air-fuel ratio of the inflowing exhaust gas and controls the amount of fuel supplied to the combustion chambers 5 so that the air-fuel ratio of the inflowing exhaust gas matches the target air-fuel ratio. The air-fuel ratio control part can control the amount of fuel supplied to the combustion chambers 5 by controlling the fuel injectors 11 etc.

For example, the air-fuel ratio control part controls by feedback the amount of fuel supplied to the combustion chambers 5 so that the air-fuel ratio detected by the upstream side air-fuel ratio sensor 40 matches the target air-fuel ratio. In this case, the upstream side air-fuel ratio sensor 40 functions as a component of the exhaust purification system. Note that, the air-fuel ratio control part may control the amount of fuel supplied to the combustion chambers 5 without using the upstream side air-fuel ratio sensor 40. In this case, the air-fuel ratio control part supplies to the combustion chambers 5 an amount of fuel calculated from the amount of intake air detected by the air flow meter 39 etc., and the target air-fuel ratio so that the ratio of fuel and air supplied to the combustion chambers 5 matches the target air-fuel ratio. Therefore, the upstream side air-fuel ratio sensor 40 may be omitted from the internal combustion engine 100.

In order to maintain the exhaust emission of the internal combustion engine 100 in a good state, it is necessary to maintain the oxygen storage ability of the upstream side catalyst 20 to keep the exhaust purification performance of the upstream side catalyst 20 from falling. In order to maintain the oxygen storage ability of the upstream side catalyst 20, the oxygen storage amount of the upstream side catalyst 20 may be made to periodically fluctuate so that the oxygen storage amount of the upstream side catalyst 20 is not maintained constant. For this reason, the air-fuel ratio control part performs rich control making the target air-fuel ratio richer than the stoichiometric air-fuel ratio so that the oxygen storage amount of the upstream side catalyst 20 decreases. The air-fuel ratio control part sets the target air-fuel ratio in the rich control to a rich set air-fuel ratio richer than the stoichiometric air-fuel ratio. The rich set air-fuel ratio is determined in advance and is set for example within the range of 12.5 to 14.5.

However, if the rich control is performed, the amount of unburned gas discharged from the combustion chambers 5 into the exhaust passage increases. For this reason, if the rich control is continued even after the oxygen of the upstream side catalyst 20 is depleted, a large amount of unburned gas flows out from the upstream side catalyst 20 and the exhaust emission deteriorates.

In the present embodiment, in order to keep a large amount of unburned gas from flowing out from the upstream side catalyst 20, the air-fuel ratio control part makes the target air-fuel ratio leaner than the stoichiometric air-fuel ratio when the output value of the ammonia sensor 46 rises to a reference value in the rich control. That is, the air-fuel ratio control part ends the rich control when the output value of the ammonia sensor 46 rises to the reference value in the rich control and performs lean control making the target air-fuel ratio leaner than the stoichiometric air-fuel ratio so that the oxygen storage amount of the upstream side catalyst 20 increases. The reference value is determined in advance and is a value corresponding to a predetermined concentration of ammonia in the exhaust gas (for example 10 ppm). Note that, the reference value is a value detected by the ammonia sensor 46 when ammonia starts to flow out from the upstream side catalyst 20. Further, the air-fuel ratio control part sets the target air-fuel ratio in the lean control to a lean set air-fuel ratio leaner than the stoichiometric air-fuel ratio. The lean set air-fuel ratio is determined in advance and is set within for example the range of 14.7 to 15.5.

Due to the above-mentioned control, before the oxygen of the upstream side catalyst 20 is depleted and a large amount of unburned gas flows out from the upstream side catalyst 20, the amount of unburned gas discharged from the combustion chambers 5 to the exhaust passage can be made to decrease and the oxygen storage amount of the upstream side catalyst 20 can be restored. Therefore, in the present embodiment, if the air-fuel ratio is made rich, the amount of unburned gas flowing out from the upstream side catalyst 20 can be suppressed.

Explanation of Air-Fuel Ratio Control Using Time Chart

Figure 8:
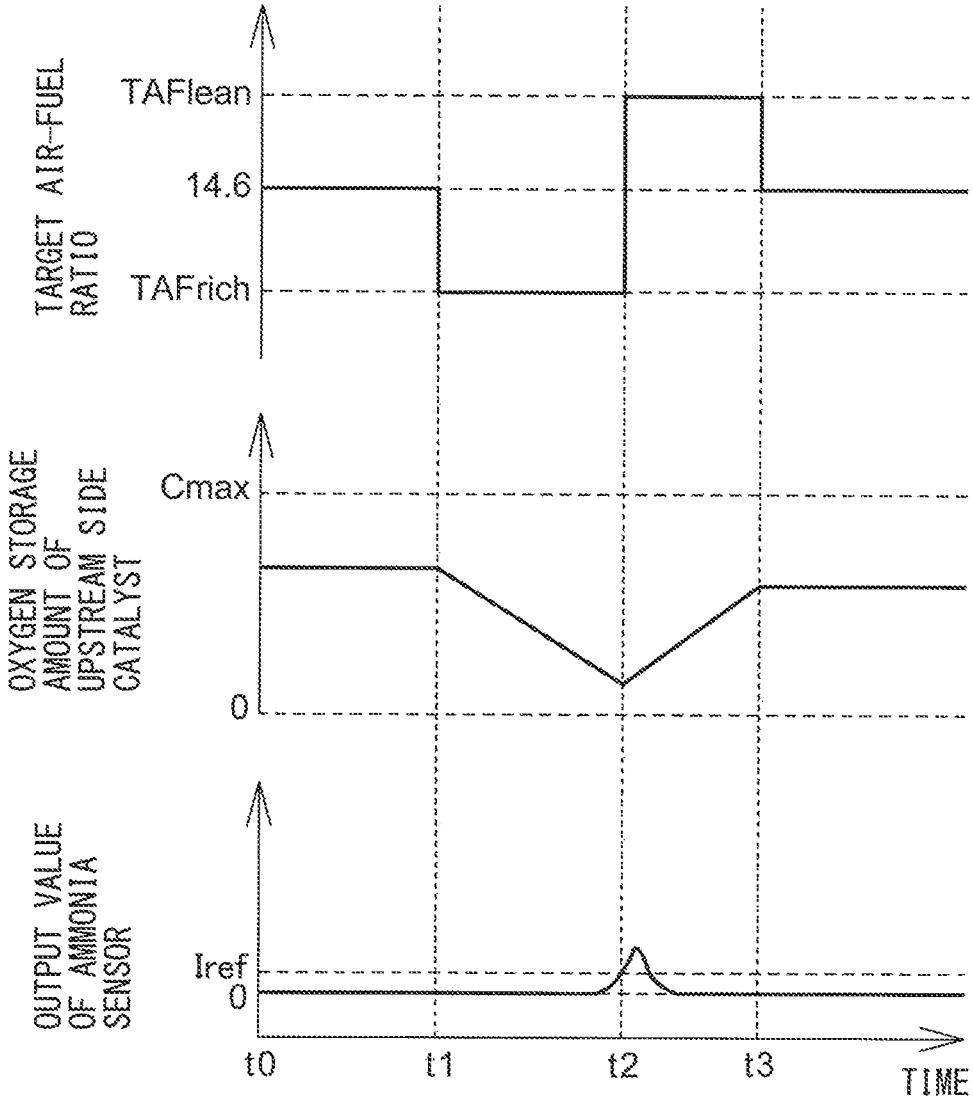
FIG. 8 is a time chart of a target air-fuel ratio of inflowing exhaust gas etc., when rich control is performed.

Below, referring to the time chart of FIG. 8, air-fuel ratio control in the first embodiment will be explained in detail. FIG. 8 is a time chart of the target air-fuel ratio of the inflowing exhaust gas, the oxygen storage amount of the upstream side catalyst 20, and the output value of the ammonia sensor 46 when the rich control is performed.

In the illustrated example, at the time t0, the target air-fuel ratio of the inflowing exhaust gas is set to the stoichiometric air-fuel ratio (14.6). Further, at the time t0, the upstream side catalyst 20 stores a sufficient amount of oxygen less than the maximum storable oxygen amount Cmax. For this reason, the output value of the ammonia sensor 46 is zero.

After that, at the time t1, the rich control is started and the target air-fuel ratio of the inflowing exhaust gas is switched from the stoichiometric air-fuel ratio to the rich set air-fuel ratio TAFrich. As a result, after the time t1, the oxygen storage amount of the upstream side catalyst 20 gradually falls.

When the oxygen storage amount of the upstream side catalyst 20 approaches zero, the oxidation reaction of ammonia at the upstream side catalyst 20 is suppressed and ammonia starts to flow out from the upstream side catalyst 20. As a result, the output value of the ammonia sensor 46 rises from zero and reaches the reference value Iref at the time t2.

For this reason, at the time t2, the target air-fuel ratio is set to the lean set air-fuel ratio TAFlean and the lean control is started. That is, the target air-fuel ratio is switched from the rich set air-fuel ratio TAFrich to the lean set air-fuel ratio TAFlean. At this time, the oxygen storage amount of the upstream side catalyst 20 is larger than zero, so almost no unburned gas flows out from the upstream side catalyst 20. After that, the target air-fuel ratio is maintained at the lean set air-fuel ratio TAFlean for a predetermined time, then at the time t3 the target air-fuel ratio is again set to the stoichiometric air-fuel ratio.

Figure 9:
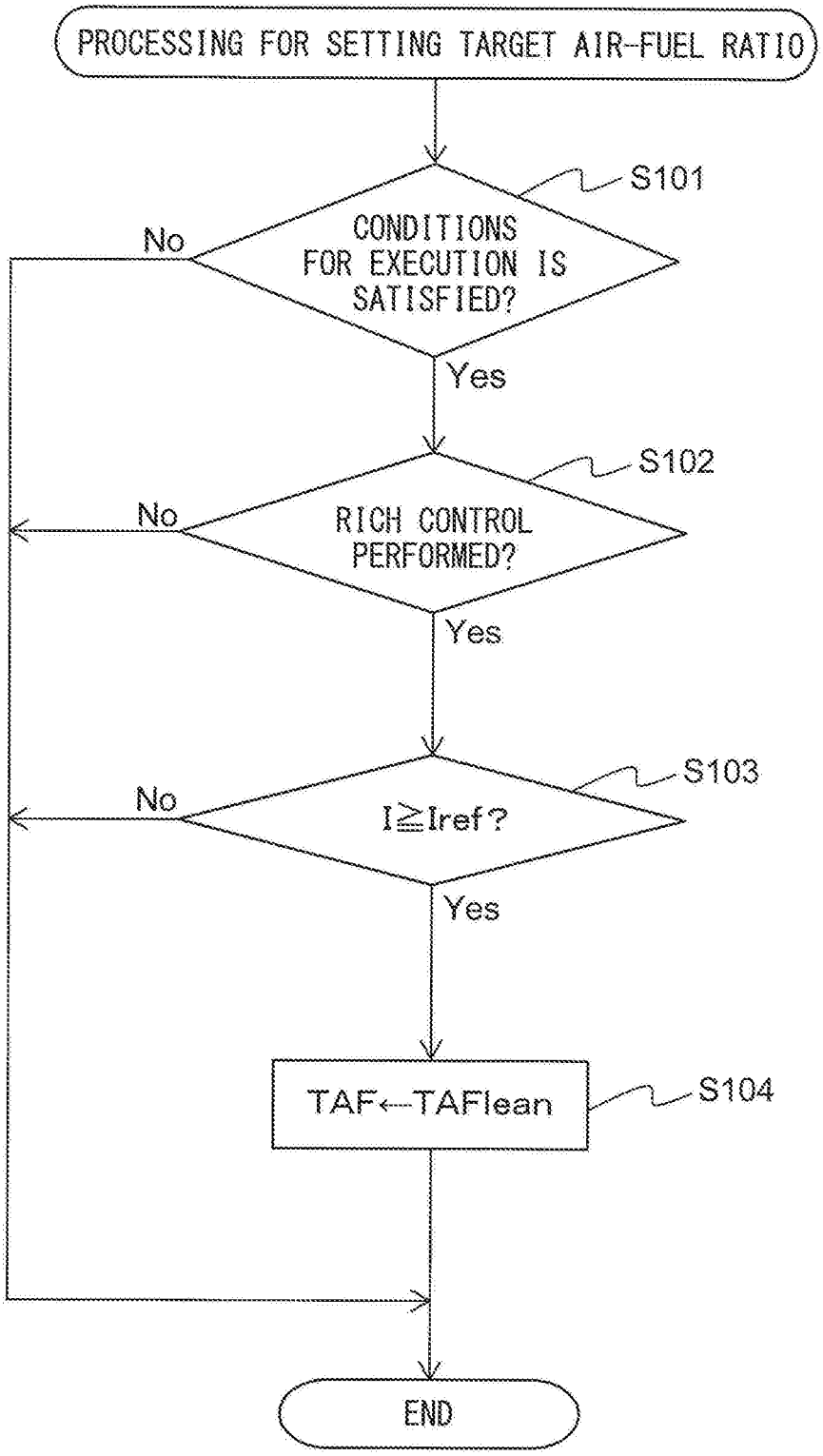
FIG. 9 is a flow chart showing a control routine for processing for setting the target air-fuel ratio in a first embodiment of the present disclosure.

Processing for Setting Target Air-Fuel Ratio Below, referring to the flow chart of FIG. 9, air-fuel ratio control where rich control is performed in the present embodiment will be explained. FIG. 9 is a flow chart showing a control routine for processing for setting the target air-fuel ratio in the first embodiment of the present disclosure. The present control routine is repeatedly performed by the ECU 31 at predetermined time intervals after the startup of the internal combustion engine 100.

First, at step S101, the air-fuel ratio control part judges whether the conditions for execution are satisfied. For example, the air-fuel ratio control part judges that the conditions for execution are satisfied if the ammonia sensor 46 is activated, and judges that the conditions for execution are not satisfied if the ammonia sensor 46 is not activated. The air-fuel ratio control part judges that the ammonia sensor 46 is activated if the temperature of the sensor element of the ammonia sensor 46 is a predetermined temperature or more. The temperature of the sensor element is calculated based on the impedance of the sensor element etc.

If it is judged at step S101 that the conditions for execution are not satisfied, the present control routine ends. On the other hand, if it is judged at step S101 that the conditions for execution are satisfied, the present control routine proceeds to step S102.

At step S102, the air-fuel ratio control part judges whether the rich control is being performed. For example, the rich control is performed at predetermined time intervals so as to make the oxygen storage amount of the upstream side catalyst 20 periodically fluctuate. Further, if fuel cut control where the supply of fuel to the combustion chambers 5 of the internal combustion engine 100 is stopped is performed, a large amount of oxygen flows into the upstream side catalyst 20 and the oxygen storage amount of the upstream side catalyst 20 reaches the maximum storable oxygen amount. For this reason, in order to reduce the oxygen storage amount of the upstream side catalyst 20, the rich control is started as well when the fuel cut control ends. The air-fuel ratio control part sets the target air-fuel ratio of the inflowing exhaust gas TAF to the rich set air-fuel ratio TAFrich when starting the rich control.

If at step S102 it is judged that the rich control is not being performed, the present control routine ends. On the other hand, if it is judged at step S102 that the rich control is being performed, the present control routine proceeds to step S103.

At step S103, the air-fuel ratio control part judges if an output value I of the ammonia sensor 46 is the reference value Iref or more. If it is judged that the output value I of the ammonia sensor 46 is less than the reference value Iref, the present control routine ends. In this case, the target air-fuel ratio TAF is maintained at the rich set air-fuel ratio TAFrich. On the other hand, if it is judged that the output value I of the ammonia sensor 46 is the reference value Iref or more, the present control routine proceeds to step S104.

At step S104, the air-fuel ratio control part sets the target air-fuel ratio TAF to the lean set air-fuel ratio TAFlean. Therefore, the air-fuel ratio control part switches the target air-fuel ratio from the rich set air-fuel ratio TAFrich to the lean set air-fuel ratio TAFlean. That is, the air-fuel ratio control part ends the rich control and starts the lean control. After step S104, the present control routine ends.

Second Embodiment

An exhaust purification system according to a second embodiment is basically similar in constitution and control to the exhaust purification system according to the first embodiment except for the points explained below. For this reason, below, the second embodiment of the present disclosure will be explained focusing on the parts different from the first embodiment.

The exhaust purification system according to the second embodiment is further provided with an air-fuel ratio detection device arranged in the exhaust passage at the downstream side of the upstream side catalyst 20 in the direction of flow of exhaust. The air-fuel ratio detection device detects the air-fuel ratio of the outflowing exhaust gas.

Figure 10:
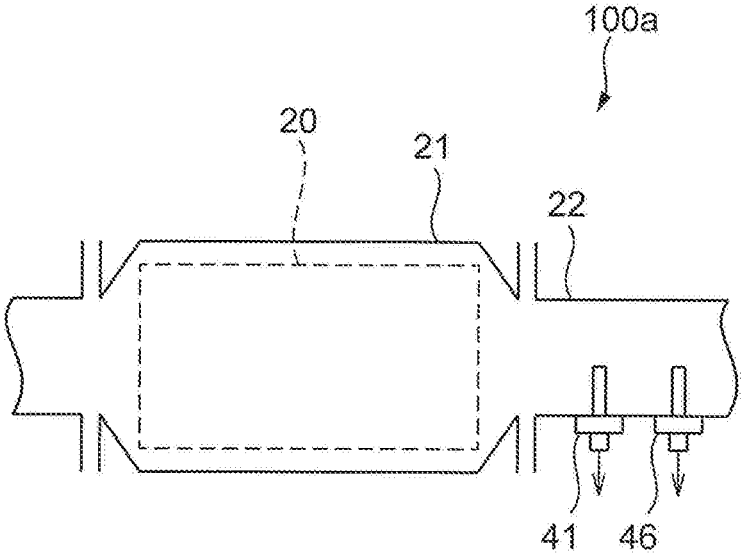
FIG. 10 is a view schematically showing a part of an exhaust passage of an internal combustion engine at which an exhaust purification system of an internal combustion engine according to a second embodiment of the present disclosure is provided.

FIG. 10 is a view schematically showing a part of the exhaust passage of an internal combustion engine 100*a* in which an exhaust purification system of an internal combustion engine 100*a* according to the second embodiment of the present disclosure is provided. In the second embodiment, inside the exhaust pipe 22, that is, at the downstream side of the upstream side catalyst 20 in the direction of flow of exhaust, a downstream side air-fuel ratio sensor 41 detecting an air-fuel ratio of exhaust gas flowing through the inside of the exhaust pipe 22 (that is, outflowing exhaust gas) is arranged. The output of the downstream side air-fuel ratio sensor 41 is transmitted to the ECU 31 in the same way as the upstream side air-fuel ratio sensor 40. In the second embodiment, the downstream side air-fuel ratio sensor 41 is configured the same as the upstream side air-fuel ratio sensor 40. Further, the downstream side air-fuel ratio sensor 41 functions as the air-fuel ratio detection device of the exhaust purification system.

In the second embodiment, the air-fuel ratio control part alternately performs lean control making the target air-fuel ratio leaner than the stoichiometric air-fuel ratio and rich control making the target air-fuel ratio richer than the stoichiometric air-fuel ratio. The air-fuel ratio control part switches the target air-fuel ratio from the rich set air-fuel ratio to the lean set air-fuel ratio when the output value of the ammonia sensor 46 rises to a reference value in the rich control and switches the target air-fuel ratio from the lean set air-fuel ratio to the rich set air-fuel ratio when the air-fuel ratio detected by the downstream side air-fuel ratio sensor 41 rises to a lean judged air-fuel ratio in the lean control.

The lean judged air-fuel ratio is determined in advance and set to a value leaner than the stoichiometric air-fuel ratio. The air-fuel ratio detected by the downstream side air-fuel ratio sensor 41 sometimes is slightly off from the stoichiometric air-fuel ratio even if the amount of oxygen of the upstream side catalyst 20 is less than the maximum storable oxygen amount. For this reason, the lean judged air-fuel ratio is set to a value close to the stoichiometric air-fuel ratio, but not detected by the downstream side air-fuel ratio sensor 41 when the amount of oxygen of the upstream side catalyst 20 is less than the maximum storable oxygen amount. The lean judged air-fuel ratio is for example 14.65. Note that, the lean set air-fuel ratio in the lean control is set to a value leaner than the lean judged air-fuel ratio.

Explanation of Air-Fuel Ratio Control Using Time Chart

Figure 11:
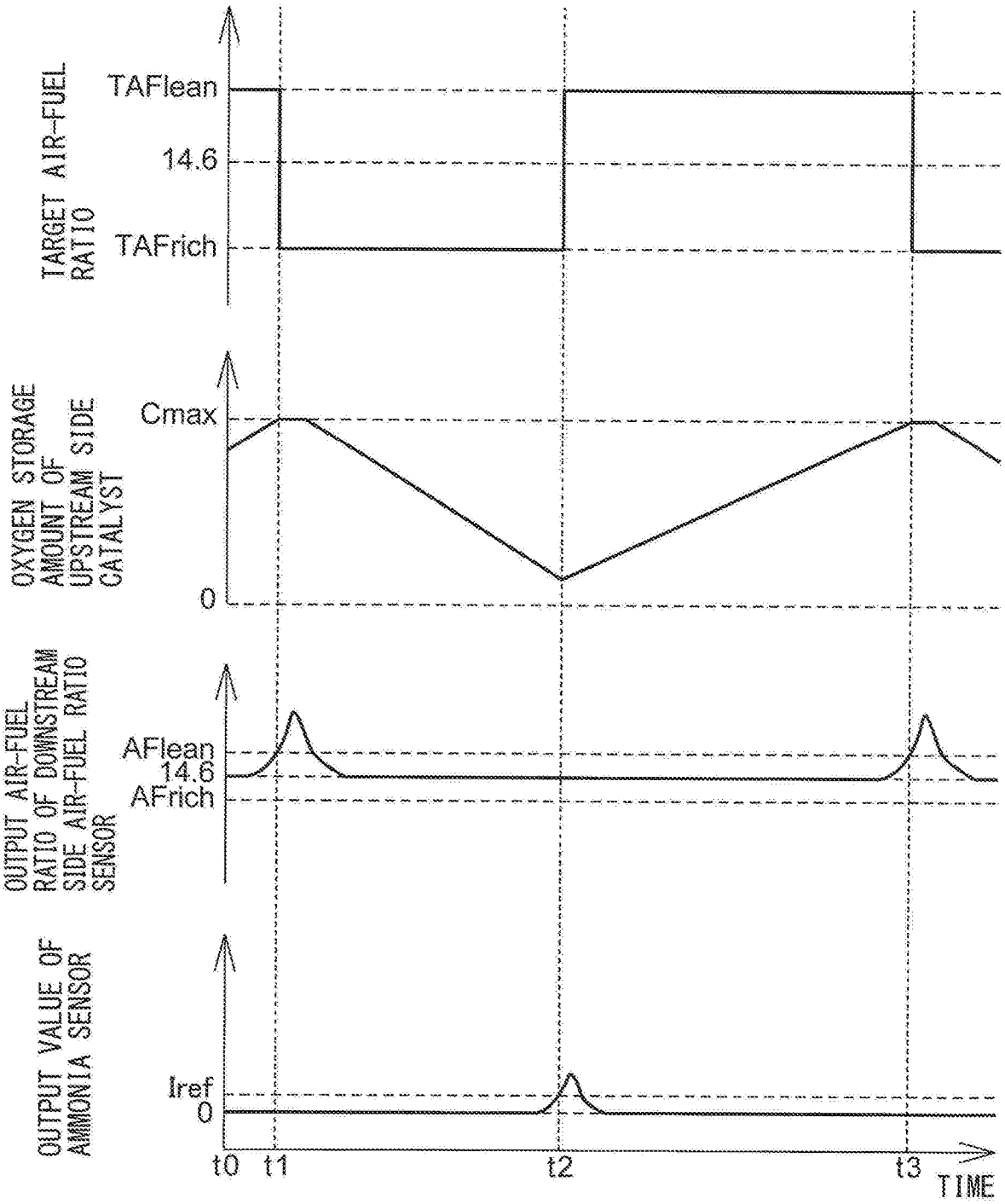
FIG. 11 is a time chart of a target air-fuel ratio of inflowing exhaust gas etc., when control of an air-fuel ratio in a second embodiment is performed.

Below, referring to the time chart of FIG. 11, air-fuel ratio control in the second embodiment will be explained in detail. FIG. 11 is a time chart of the target air-fuel ratio of the inflowing exhaust gas, the oxygen storage amount of the upstream side catalyst 20, the air-fuel ratio detected by the downstream side air-fuel ratio sensor 41 (output air-fuel ratio of the downstream side air-fuel ratio sensor 41), and the output value of the ammonia sensor 46 when the air-fuel ratio control in the second embodiment is performed.

In the illustrated example, at the time t0, the target air-fuel ratio of the inflowing exhaust gas is set to the lean set air-fuel ratio TAFlean. That is, at the time t0, the lean control is performed. For this reason, at the time t0, the oxygen storage amount of the upstream side catalyst 20 increases.

After the time t0, the oxygen storage amount of the upstream side catalyst 20 approaches the maximum storable oxygen amount Cmax and oxygen and $NO_X$ start to flow out from the upstream side catalyst 20. As a result, at the time t1, the output air-fuel ratio of the downstream side air-fuel ratio sensor 41 rises to the lean judged air-fuel ratio AFlean. At this time, the oxygen storage amount of the upstream side catalyst 20 is the maximum storable oxygen amount Cmax.

At the time t1, the target air-fuel ratio is switched from the lean set air-fuel ratio TAFlean to the rich set air-fuel ratio TAFrich and the rich control is started. For this reason, after the time t1, the oxygen storage amount of the upstream side catalyst 20 gradually decreases and the output air-fuel ratio of the downstream side air-fuel ratio sensor 41 falls to the stoichiometric air-fuel ratio.

If the oxygen storage amount of the upstream side catalyst 20 approaches zero, the oxidation reaction of ammonia at the upstream side catalyst 20 is suppressed and ammonia starts to flow out from the upstream side catalyst 20. As a result, the output value of the ammonia sensor 46 rises from zero and, at the time t2, reaches the reference value Iref. For this reason, at the time t2, the target air-fuel ratio is switched from the rich set air-fuel ratio TAFrich to the lean set air-fuel ratio TAFlean and the lean control is started.

After the time t2, if the oxygen storage amount of the upstream side catalyst 20 approaches the maximum storable oxygen amount Cmax, oxygen and $NO_X$ start to flow out from the upstream side catalyst 20. As a result, at the time t3, the output air-fuel ratio of the downstream side air-fuel ratio sensor 41 rises to the lean judged air-fuel ratio AFlean. For this reason, at the time t3, the target air-fuel ratio is switched from the lean set air-fuel ratio TAFlean to the rich set air-fuel ratio TAFrich and the rich control is again started. After that, the control from the above time t1 to time t3 is repeated.

As explained above, if the oxygen storage amount of the upstream side catalyst 20 is maintained constant, the oxygen storage ability of the upstream side catalyst 20 falls. In the second embodiment, as shown in FIG. 11, the lean control and the rich control are repeated so that the oxygen storage amount of the upstream side catalyst 20 constantly fluctuates. Therefore, it is possible to further suppress the drop in exhaust purification performance of the upstream side catalyst 20.

Further, in the second embodiment as well, the control routine for processing for setting the target air-fuel ratio shown in FIG. 9 is performed. Note that, the air-fuel ratio control part may perform the lean control for exactly a predetermined time. That is, the air-fuel ratio control part may switch the target air-fuel ratio from the lean set air-fuel ratio to the rich set air-fuel ratio when a predetermined time elapses from when the lean control is started. The predetermined time is determined in advance and set to a value where the oxygen storage amount of the upstream side catalyst 20 does not reach the maximum storable oxygen amount in the lean control.

Further, the air-fuel ratio control part may switch the target air-fuel ratio from the lean set air-fuel ratio to the rich set air-fuel ratio when the estimated value of the oxygen storage amount of the upstream side catalyst 20 rises up to a reference amount in the lean control. The reference amount is determined in advance and set to a value smaller than the maximum storable oxygen amount of the upstream side catalyst 20. The estimated value of the oxygen storage amount of the upstream side catalyst 20 is calculated based on the air-fuel ratio detected by the upstream side air-fuel ratio sensor 40 or the target air-fuel ratio of the inflowing exhaust gas, fuel injection amount of the fuel injectors 11, etc.

If these alternative controls are performed, it is possible to suppress the outflow of $NO_X$ from the upstream side catalyst 20 at the time of end of the lean control, that is, at the time of start of the rich control. Further, since the output of the downstream side air-fuel ratio sensor 41 is not used for air-fuel ratio control, the exhaust purification system need not be provided with the downstream side air-fuel ratio sensor 41.

Third Embodiment

An exhaust purification system according to a third embodiment is basically similar in constitution and control to the exhaust purification system according to the first embodiment except for the points explained below. For this reason, below, the third embodiment of the present disclosure will be explained focusing on the parts different from the first embodiment.

If the temperature of the outflowing exhaust gas is high, the ammonia flowing out from the upstream side catalyst 20 is decomposed by the heat of the exhaust gas. For this reason, the higher the temperature of the outflowing exhaust gas, the smaller the amount of the ammonia flowing out from the upstream side catalyst 20 and the smaller the amount of change of the concentration of ammonia in the outflowing exhaust gas. As a result, it is not possible to detect the change of the ammonia concentration and it is liable to be unable to switch the target air-fuel ratio of the inflowing exhaust gas to the lean set air-fuel ratio before a large amount of unburned gas flows out from the upstream side catalyst 20.

For this reason, in the third embodiment, the threshold value of the ammonia concentration when switching the target air-fuel ratio to the lean set air-fuel ratio is made to change in accordance with the temperature of the outflowing exhaust gas. The exhaust purification system according to the third embodiment is further provided with a temperature detection part detecting the temperature of the outflowing exhaust gas. In the third embodiment, the ECU 31 functions as the air-fuel ratio control part and the temperature detection part.

Figure 12:
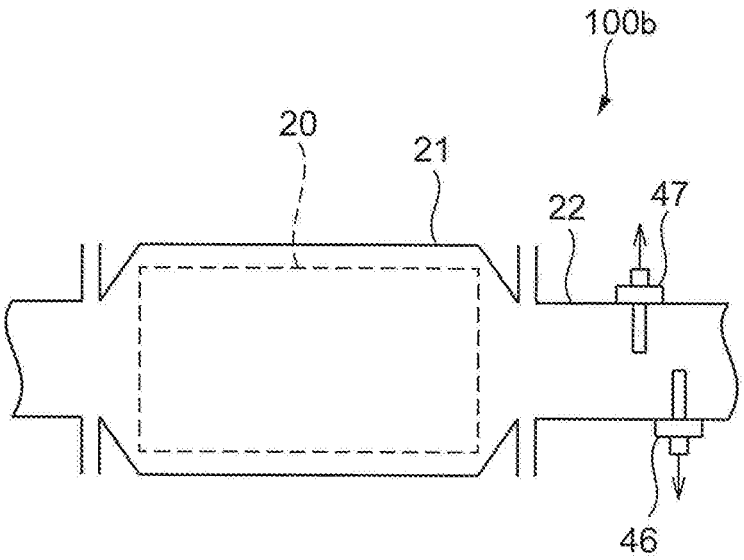
FIG. 12 is a view schematically showing a part of an exhaust passage of an internal combustion engine at which an exhaust purification system of an internal combustion engine according to a third embodiment of the present disclosure is provided.

FIG. 12 is a view schematically showing a part of the exhaust passage of the internal combustion engine 100*b* at which the exhaust purification system of the internal combustion engine 100*b* according to the third embodiment of the present disclosure is provided. For example, the temperature detection part uses a temperature sensor 47 to detect the temperature of the outflowing exhaust gas. In this case, the temperature sensor 47 functions as a component of the exhaust purification system. As shown in FIG. 12, the temperature sensor 47 is arranged at the downstream side from the upstream side catalyst 20 in the direction of flow of exhaust, specifically, in the exhaust pipe 22 between the upstream side catalyst 20 and the downstream side catalyst 24. The output of the temperature sensor 47 is transmitted to the ECU 31.

Note that, the temperature detection part may detect the temperature of the upstream side catalyst 20. In this case, the temperature sensor 47 is arranged at the upstream side casing 21 housing the upstream side catalyst 20. Further, the temperature detection part may estimate the temperature of the upstream side catalyst 20 or the outflowing exhaust gas based on the operating state of the internal combustion engine 100*b*. In this case, the exhaust purification system need not be provided with the temperature sensor 47.

For example, the temperature detection part estimates the temperature of the upstream side catalyst 20 or the outflowing exhaust gas based on the amount of intake air. The amount of intake air is, for example, detected by the air flow meter 39. The temperature detection part estimates the temperature of the upstream side catalyst 20 or the outflowing exhaust gas higher the greater the amount of intake air.

In the same way as the first embodiment, the air-fuel ratio control part makes the target air-fuel ratio leaner than the stoichiometric air-fuel ratio when the output value of the ammonia sensor 46 rises to the reference value in the rich control. Further, in the third embodiment, the air-fuel ratio control part makes the reference value smaller the higher the temperature detected or estimated by the temperature detection part. In the third embodiment, due to this control, it is possible to keep a large amount of unburned gas from flowing out from the upstream side catalyst 20 without detecting a change of the ammonia concentration. Note that, as explained above, the greater the amount of intake air, the higher the temperature of the upstream side catalyst 20 or the outflowing exhaust gas is estimated, so the air-fuel ratio control part may make the reference value smaller the greater the amount of intake air.

Figure 13:
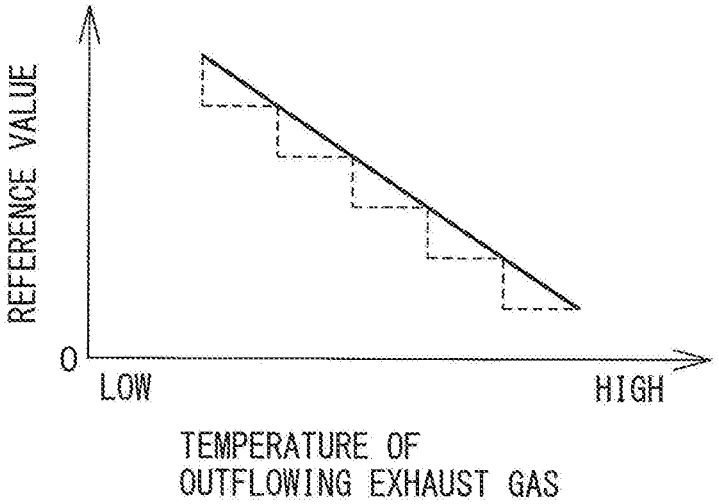
FIG. 13 is a map showing a relationship between a temperature of outflowing exhaust gas and a reference value.

For example, the air-fuel ratio control part uses a map such as shown in FIG. 13 to set the reference value ratio. In this map, the reference value is shown as a function of the temperature of the outflowing exhaust gas. As shown by the solid line in FIG. 13, the reference value is linearly made smaller the higher the temperature of the outflowing exhaust gas becomes. Note that, the reference value, as shown by the broken line in FIG. 13, may be made smaller in stages (in steps) along with a rise in the temperature of the outflowing exhaust gas.

Processing for Setting Reference Value

Figure 14:
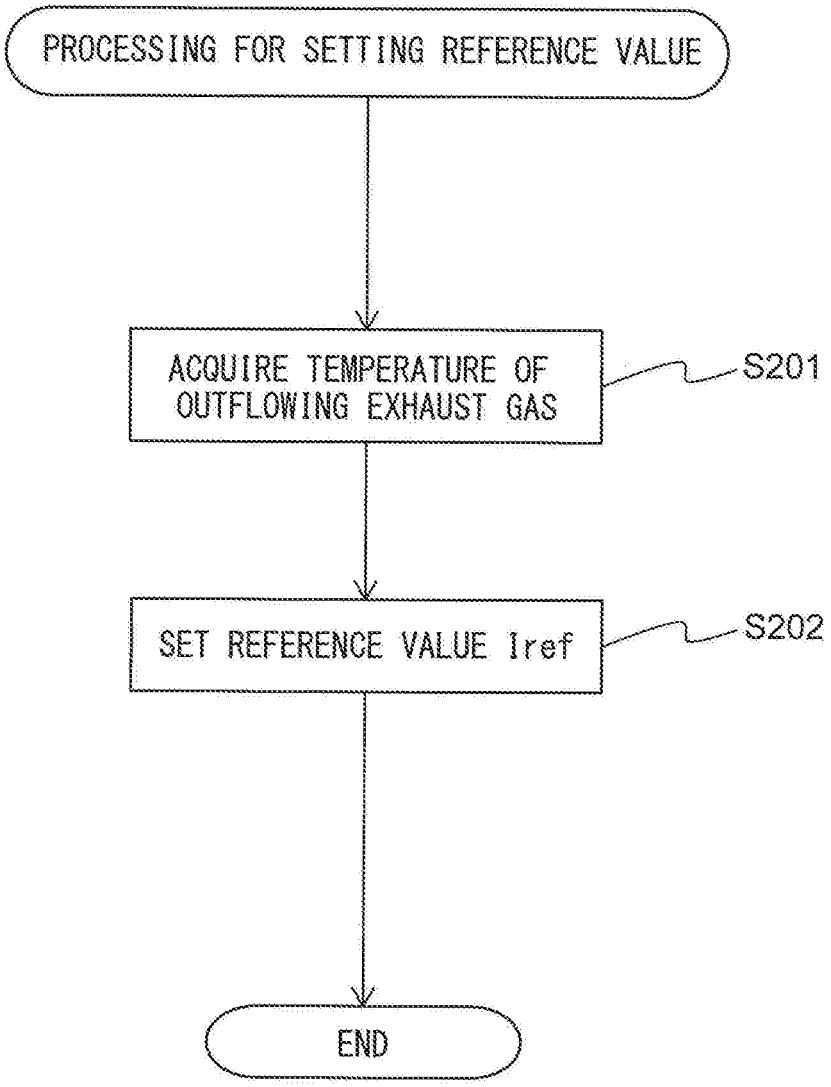
FIG. 14 is a flow chart showing a control routine of processing for setting a reference value in a third embodiment of the present disclosure.

FIG. 14 is a flow chart showing a control routine of processing for setting the reference value at the third embodiment of the present disclosure. The present control routine is repeatedly performed by the ECU 31 at predetermined time intervals after the startup of the internal combustion engine 100*b*.

First, at step S201, the air-fuel ratio control part acquires the temperature of the outflowing exhaust gas. The temperature of the outflowing exhaust gas is detected or estimated by the temperature detection part. Next, at step S202, the air-fuel ratio control part sets the reference value Iref based on the temperature of the outflowing exhaust gas. For example, the air-fuel ratio control part uses a map such as shown in FIG. 13 to set the reference value Iref. After step S202, the present control routine ends. Note that, at step S201, the air-fuel ratio control part may obtain the temperature of the upstream side catalyst 20. The temperature of the upstream side catalyst 20 is detected or estimated by the temperature detection part.

Further, in the third embodiment as well, the control routine for processing for setting the target air-fuel ratio shown in FIG. 9 is performed. In the third embodiment, at step S103 of FIG. 9, the reference value Iref set at step S202 of FIG. 14 is used.

Fourth Embodiment

An exhaust purification system according to a fourth embodiment is basically similar in constitution and control to the exhaust purification system according to the first embodiment except for the points explained below. For this reason, below, the fourth embodiment of the present disclosure will be explained focusing on the parts different from the first embodiment.

As explained above, if the temperature of the outflowing exhaust gas is high, the ammonia flowing out from the upstream side catalyst 20 is decomposed by the heat of the exhaust gas. For this reason, the higher the temperature of the outflowing exhaust gas, the smaller the amount of the ammonia flowing out from the upstream side catalyst 20 and the more delayed the timing at which a change in the concentration of ammonia in the outflowing exhaust gas is detected. As a result, even if making the target air-fuel ratio of the inflowing exhaust gas the lean set air-fuel ratio when a change of the ammonia concentration is detected, the amount of unburned gas flowing out from the upstream side catalyst 20 is liable to be unable to be effectively suppressed.

For this reason, in the fourth embodiment, the value of the rich set air-fuel ratio in the rich control is made to change in accordance with the temperature of the outflowing exhaust gas. The exhaust purification system according to the fourth embodiment, in the same way as the third embodiment, is further provided with a temperature detection part detecting or estimating the temperature of the outflowing exhaust gas. In the fourth embodiment, the ECU 31 functions as the air-fuel ratio control part and the temperature detection part.

In the fourth embodiment, the air-fuel ratio control part makes the rich degree of the target air-fuel ratio in the rich control smaller the higher the temperature detected or estimated by the temperature detection part. In other words, the air-fuel ratio control part shifts the rich set air-fuel ratio to the leaner side (makes it approach the stoichiometric air-fuel ratio) more the higher the temperature detected or estimated by the temperature detection part. In the fourth embodiment, due to this control, it is possible to keep a large amount of unburned gas from flowing out from the upstream side catalyst 20 when the timing for making the target air-fuel ratio of the inflowing exhaust gas the lean set air-fuel ratio is delayed. Note that, regarding the third embodiment, as explained above, the larger the amount of intake air, the higher the temperature of the upstream side catalyst 20 or outflowing exhaust gas estimated. For this reason, the air-fuel ratio control part may make the rich degree of the target air-fuel ratio in the rich control smaller the greater the amount of intake air. Note that, the "rich degree" means the difference between the target air-fuel ratio set to a value richer than the stoichiometric air-fuel ratio and the stoichiometric air-fuel ratio.

Figure 15:
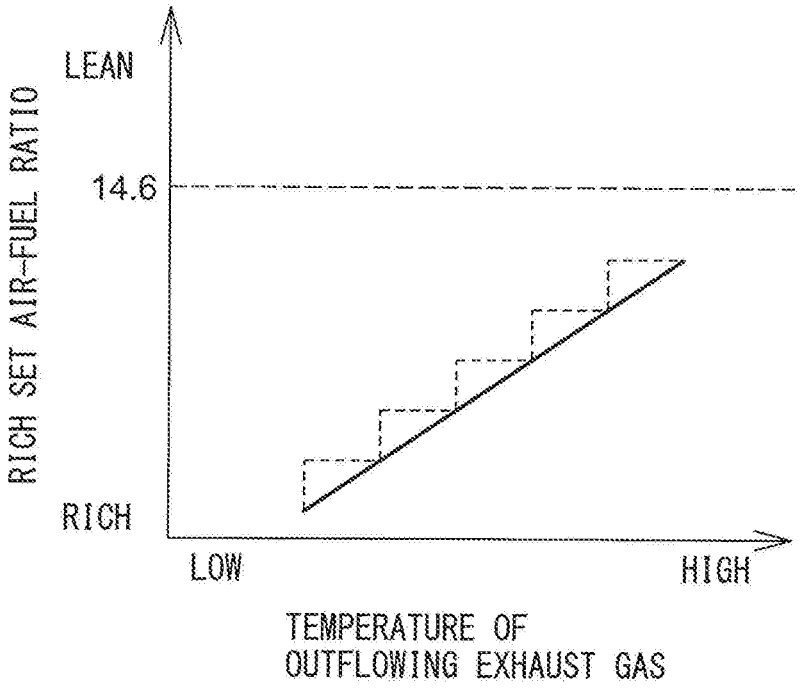
FIG. 15 is a map showing a relationship between a temperature of outflowing exhaust gas and a rich set air-fuel ratio.

For example, the air-fuel ratio control part uses a map such as shown in FIG. 15 to set the rich set air-fuel ratio. In this map, the rich set air-fuel ratio is shown as a function of the temperature of the outflowing exhaust gas. As shown by the solid line in FIG. 15, the rich set air-fuel ratio is linearly made leaner (made higher) the higher the temperature of the outflowing exhaust gas becomes. Note that, the rich set air-fuel ratio, as shown by the broken line in FIG. 15, may be made leaner in stages (in steps) along with a rise in the temperature of the outflowing exhaust gas.

Processing for Setting Rich Set Air-Fuel Ratio

Figure 16:
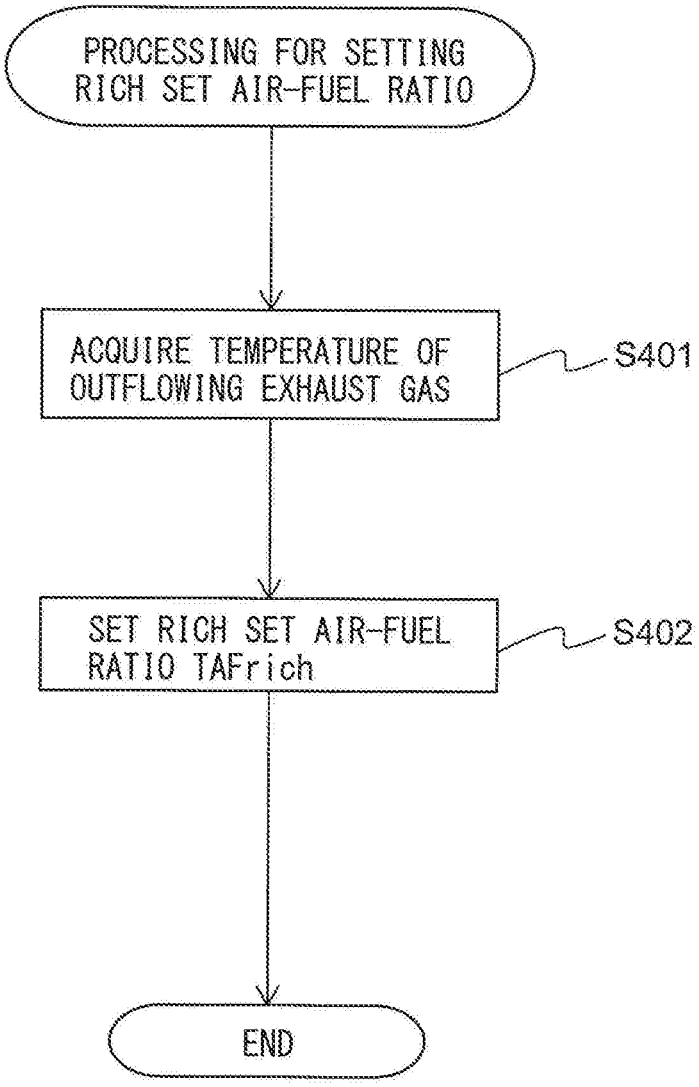
FIG. 16 is a flow chart showing a control routine of processing for setting a rich set air-fuel ratio in a fourth embodiment of the present disclosure.

FIG. 16 is a flow chart showing a control routine of processing for setting a rich set air-fuel ratio in the fourth embodiment of the present disclosure. The present control routine is repeatedly performed by the ECU 31 at predetermined time intervals after the startup of the internal combustion engine 100*b*.

First, at step S401, the air-fuel ratio control part acquires the temperature of the outflowing exhaust gas. The temperature of the outflowing exhaust gas is detected or estimated by the temperature detection part. Next, at step S402, the air-fuel ratio control part sets the rich set air-fuel ratio TAFrich based on the temperature of the outflowing exhaust gas. For example, the air-fuel ratio control part uses a map such as shown in FIG. 15 to set the rich set air-fuel ratio TAFrich. After step S402, the present control routine ends. Note that, at step S401, the air-fuel ratio control part may acquire the temperature of the upstream side catalyst 20. The temperature of the upstream side catalyst 20 is detected or estimated by the temperature detection part.

Further, in the fourth embodiment as well, the control routine for processing for setting the target air-fuel ratio shown in FIG. 9 is executed. In the fourth embodiment, in the rich control, the target air-fuel ratio of the inflowing exhaust gas is set to the rich set air-fuel ratio TAFrich set at step S402 of FIG. 16.

Fifth Embodiment

An exhaust purification system according to a fifth embodiment is basically similar in constitution and control to the exhaust purification system according to the first embodiment except for the points explained below. For this reason, below, the fifth embodiment of the present disclosure will be explained focusing on the parts different from the first embodiment.

The exhaust purification system according to the fifth embodiment, like the second embodiment, is further provided with an air-fuel ratio detection device arranged in the exhaust passage at a downstream side of the upstream side catalyst 20 in the direction of flow of exhaust. In the same way as the second embodiment, the downstream side air-fuel ratio sensor 41 shown in FIG. 10 functions as the air-fuel ratio detection device.

As explained above, in the outflowing exhaust gas, the ammonia concentration rises faster than the concentration of unburned gas. For this reason, usually, a change of the concentration of ammonia in the outflowing exhaust gas is detected before a change of the air-fuel ratio of the outflowing exhaust gas.

However, as explained above, if the temperature of the outflowing exhaust gas is high, the ammonia flowing out from the upstream side catalyst 20 is decomposed by the heat of the exhaust gas. For this reason, if the temperature of the outflowing exhaust gas is extremely high, sometimes the change of the concentration of ammonia in the outflowing exhaust gas cannot be detected.

Further, the ammonia sensor 46 gradually deteriorates along with use. If due to deterioration etc., an abnormality arises in the output characteristic of the ammonia sensor 46, the timing when the change of the concentration of ammonia in the outflowing exhaust gas is detected by the ammonia sensor 46 is sometimes delayed from the timing at which a large amount of unburned gas starts to flow out from the upstream side catalyst 20.

For this reason, in the fifth embodiment, in the rich control, if the air-fuel ratio detected by the downstream side air-fuel ratio sensor 41 falls to a rich judged air-fuel ratio before the output value of the ammonia sensor 46 rises to the reference value, the air-fuel ratio control part makes the target air-fuel ratio leaner than the stoichiometric air-fuel ratio when the air-fuel ratio detected by the downstream side air-fuel ratio sensor 41 falls to the rich judged air-fuel ratio. On the other hand, in the rich control, if the output value of the ammonia sensor 46 rises to the reference value before the air-fuel ratio detected by the downstream side air-fuel ratio sensor 41 falls to the rich judged air-fuel ratio, the air-fuel ratio control part makes the target air-fuel ratio leaner than the stoichiometric air-fuel ratio when the output value of the ammonia sensor 46 rises to the reference value.

The rich judged air-fuel ratio is determined in advance and set to a value richer than the stoichiometric air-fuel ratio. The air-fuel ratio detected by the downstream side air-fuel ratio sensor 41 sometimes is slightly off from the stoichiometric air-fuel ratio even if the upstream side catalyst 20 stores oxygen. For this reason, the rich judged air-fuel ratio is set to a value which is close to the stoichiometric air-fuel ratio, but which is not detected by the downstream side air-fuel ratio sensor 41 when oxygen remains in the upstream side catalyst 20. The rich judged air-fuel ratio is for example 14.55. Note that, the rich set air-fuel ratio in the rich control is set to a value richer than the rich judged air-fuel ratio.

Due to the above-mentioned control, even if the output of the ammonia sensor 46 does not change or the change of the output of the ammonia sensor 46 is delayed, it is possible to end the rich control when the air-fuel ratio detected by the downstream side air-fuel ratio sensor 41 falls to the rich judged air-fuel ratio. For this reason, it is possible to keep the rich control from continuing even after a large amount of unburned gas starts to flow out from the upstream side catalyst 20 and to thereby keep a large amount of unburned gas from flowing out from the upstream side catalyst 20.

Processing for Setting Target Air-Fuel Ratio

Figure 17:
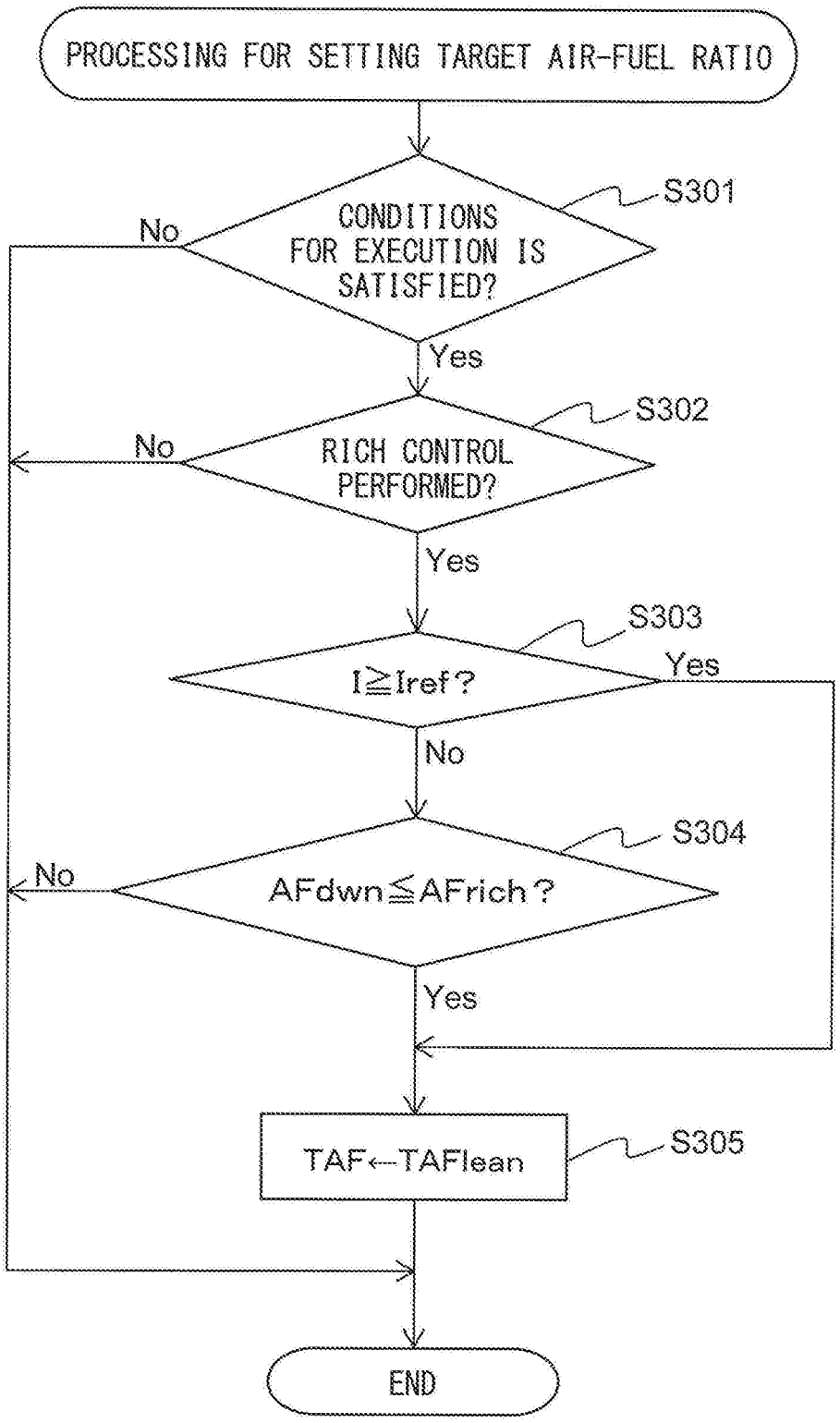
FIG. 17 is a flow chart showing a control routine of processing for setting a target air-fuel ratio in a fourth embodiment of the present disclosure.

FIG. 17 is a flow chart showing a control routine for processing for setting the target air-fuel ratio in the fifth embodiment of the present disclosure. The present control routine is repeatedly performed by the ECU 31 at predetermined time intervals after the startup of the internal combustion engine 100.

First, at step S301, the air-fuel ratio control part judges whether the conditions for execution are satisfied. For example, the air-fuel ratio control part judges that the conditions for execution are satisfied if the downstream side air-fuel ratio sensor 41 and ammonia sensor 46 are activated and judges that the conditions for execution are not satisfied if at least one of the downstream side air-fuel ratio sensor 41 and ammonia sensor 46 is not activated. The air-fuel ratio control part judges that the downstream side air-fuel ratio sensor 41 and ammonia sensor 46 are activated if the temperatures of the sensor elements of the downstream side air-fuel ratio sensor 41 and ammonia sensor 46 are a predetermined temperature or more. The temperatures of the sensor elements are calculated based on the impedances of the sensor elements.

If at step S301 it is judged that the conditions for execution are not satisfied, the present control routine ends. On the other hand, if at step S301 it is judged that the conditions for execution are satisfied, the present control routine proceeds to step S302.

At step S302, in the same way as step S102 of FIG. 9, the air-fuel ratio control part judges whether the rich control is being performed. If it is judged that the rich control is not being performed, the present control routine ends. On the other hand, if it is judged that the rich control is being performed, the present control routine proceeds to step S303.

At step S303, the air-fuel ratio control part judges whether the output value I of the ammonia sensor 46 is the reference value Iref or more. If it is judged that the output value I of the ammonia sensor 46 is less than the reference value Iref, the present control routine proceeds to step S304.

At step S304, the air-fuel ratio control part judges whether the air-fuel ratio AFdwn detected by the downstream side air-fuel ratio sensor 41 is the rich judged air-fuel ratio AFrich or less. If it is judged that the air-fuel ratio AFdwn is higher than the rich judged air-fuel ratio AFrich (is lean), the present control routine ends. In this case, the target air-fuel ratio TAF is maintained at the rich set air-fuel ratio TAFrich. On the other hand, if it is judged that air-fuel ratio AFdwn is the rich judged air-fuel ratio AFrich or less, the present control routine proceeds to step S305.

Further, if at step S303 it is judged that the output value I of the ammonia sensor 46 is the reference value Iref or more, the present control routine skips step S304 and proceeds to step S305.

At step S305, the air-fuel ratio control part sets the target air-fuel ratio TAF to the lean set air-fuel ratio TAFlean. Therefore, the air-fuel ratio control part switches the target air-fuel ratio from the rich set air-fuel ratio TAFrich to the lean set air-fuel ratio TAFlean. That is, the air-fuel ratio control part ends the rich control and starts the lean control. After step S305, the present control routine ends.

Sixth Embodiment

The exhaust purification system according to a sixth embodiment is basically similar in configuration and control to the exhaust purification system according to the first embodiment except for the points explained below. For this reason, below, the sixth embodiment of the present disclosure will be explained focusing on the parts different from the first embodiment.

Figure 18:
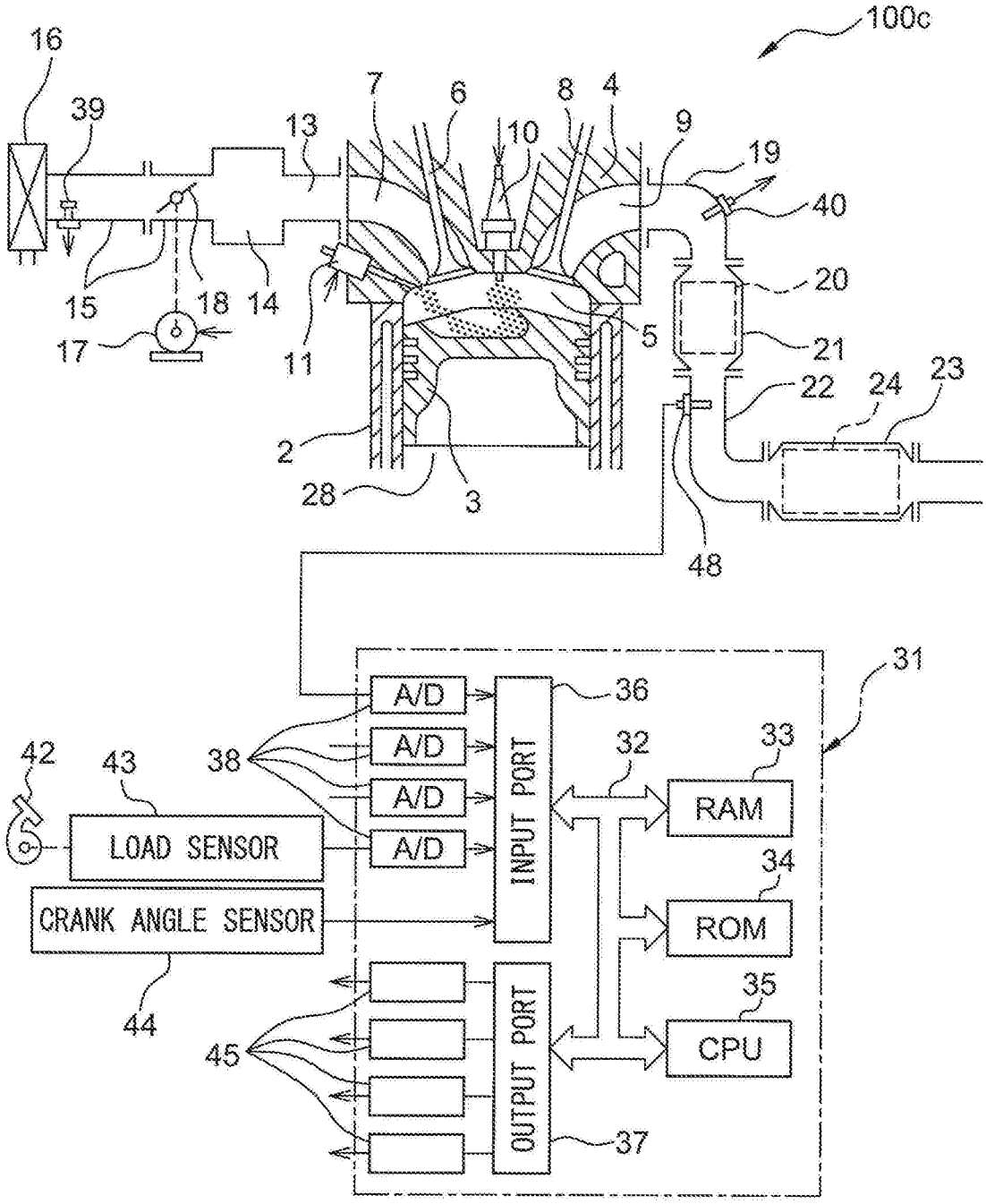
FIG. 18 is a view schematically showing an internal combustion engine at which an exhaust purification system of an internal combustion engine according to a fifth embodiment of the present disclosure is provided.

FIG. 18 is a view schematically showing an internal combustion engine 100*c* provided with an exhaust purification1 system of an internal combustion engine 100*c* according to the sixth embodiment of the present disclosure. In the sixth embodiment, inside the exhaust pipe 22, that is, at the downstream side of the upstream side catalyst 20 in the direction of flow of exhaust, a nitrogen oxide sensor ($NO_X$ sensor) 48 detecting the concentration of nitrogen oxides ($NO_X$ concentration) in the exhaust gas flowing through the exhaust pipe 22 (that is, exhaust gas flowing out from the upstream side catalyst 20) is arranged. The $NO_X$ sensor 48 is arranged between the upstream side catalyst 20 and the downstream side catalyst 24 in the direction of flow of exhaust. The output of the $NO_X$ sensor 48 is input through the corresponding AD converter 38 to the input port 36.

In the present embodiment, the $NO_X$ sensor 48 is a limit current type $NO_X$ sensor calculating an $NO_X$ concentration in the exhaust gas by detecting a limit current flowing in the sensor when applying a predetermined voltage. The $NO_X$ sensor 48 itself is known, so below the configuration of the $NO_X$ sensor 48 and the principle of detection of the $NO_X$ will be briefly explained.

Figure 19:
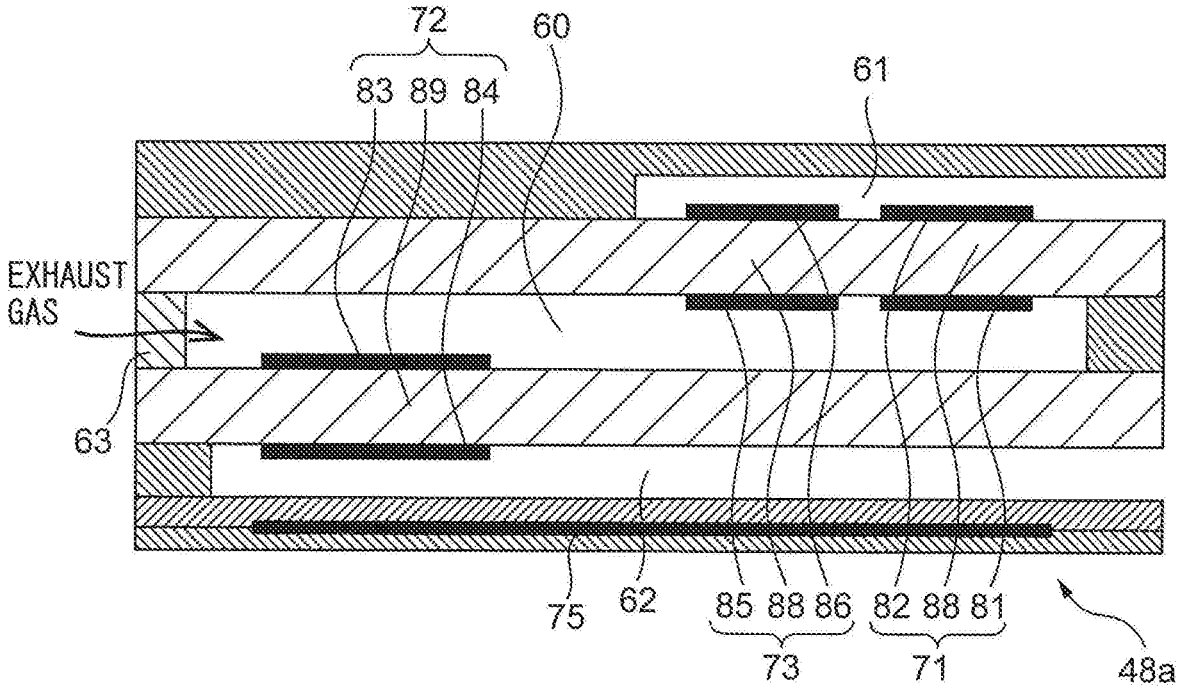
FIG. 19 is a cross-sectional view of a sensor element of an $NO_X$ sensor.

FIG. 19 is a cross-sectional view of a sensor element 48*a* of an $NO_X$ sensor 48. As shown in FIG. 19, the sensor element 48*a* of the $NO_X$ sensor 48 is provided with a measured gas chamber 60, first reference gas chamber 61, second reference gas chamber 62, sensor cell 71, pump cell 72, monitor cell 73, and heater 75. In the measured gas chamber 60, outflowing exhaust gas is introduced as measured gas through the diffusion regulating layer 63. In the first reference gas chamber 61 and second reference gas chamber 62, reference gas is introduced. The reference gas is for example air. In this case, the first reference gas chamber 61 and the second reference gas chamber 62 are opened to the atmosphere.

The sensor cell 71 is an electrochemical cell having a sensor solid electrolyte layer, first electrode 81, and second electrode 82. In the present embodiment, the first solid electrolyte layer 88 functions as the sensor solid electrolyte layer. The first electrode 81 is arranged on the surface of the measured gas chamber 60 side of the first solid electrolyte layer 88 so as to be exposed to the measured gas inside the measured gas chamber 60. On the other hand, the second electrode 82 is arranged on the surface of the first reference gas chamber 61 side of the first solid electrolyte layer 88 so as to be exposed to the reference gas inside the first reference gas chamber 61. The first electrode 81 and second electrode 82 are arranged so as to face each other across the first solid electrolyte layer 88. The first electrode 81 is comprised of a material having an $NO_X$ decomposition function.

The pump cell 72 is an electrochemical cell having a pump solid electrolyte layer, third electrode 83, and fourth electrode 84. In the present embodiment, the second solid electrolyte layer 89 functions as the pump solid electrolyte layer. The third electrode 83 is arranged on the surface of the measured gas chamber 60 side of the second solid electrolyte layer 89 so as to be exposed to the measured gas inside the measured gas chamber 60. On the other hand, the fourth electrode 84 is arranged on the surface of the second reference gas chamber 62 side of the second solid electrolyte layer 89 so as to be exposed to the reference gas inside the second reference gas chamber 62. The third electrode 83 and the fourth electrode 84 are arranged so as to face each other across the second solid electrolyte layer 89. The third electrode 83 is comprised of a material not having an $NO_X$ decomposition function.

The monitor cell 73 is an electrochemical cell having a monitor solid electrolyte layer, fifth electrode 85, and sixth electrode 86. In the present embodiment, the first solid electrolyte layer 88 functions as the monitor solid electrolyte layer. Therefore, in the present embodiment, the sensor solid electrolyte layer and monitor solid electrolyte layer are made from a common solid electrolyte layer. The fifth electrode 85 is arranged on the surface of the measured gas chamber 60 side of the first solid electrolyte layer 88 so as to be exposed to the measured gas inside the measured gas chamber 60. On the other hand, the sixth electrode 86 is arranged on the surface of the first reference gas chamber 61 side of the first solid electrolyte layer 88 so as to be exposed to the reference gas inside the first reference gas chamber 61. The fifth electrode 85 and the sixth electrode 86 are arranged so as to face each other across the first solid electrolyte layer 88. The fifth electrode 85 is comprised of a material not having an $NO_X$ decomposition function.

As shown in FIG. 19, the pump cell 72 is arranged at the upstream side from the sensor cell 71 in the direction of flow of the measured gas. The monitor cell 73 is arranged between the pump cell 72 and sensor cell 71 in the direction of flow of the measured gas. The heater 75 heats the sensor element 48*a*, in particular, the sensor cell 71, pump cell 72, and monitor cell 73.

Note that, the specific configuration of the sensor element 48*a* may differ from the configuration shown in FIG. 19. For example, the sensor solid electrolyte layer, pump solid electrolyte layer, and monitor solid electrolyte layer may be a common solid electrolyte layer or separate solid electrolyte layers.

The $NO_X$ concentration in the measured gas is detected as follows using the $NO_X$ sensor 48. The outflowing exhaust gas passes through the diffusion regulating layer 63 and is introduced into the measured gas chamber 60 as measured gas. The measured gas introduced to the inside of the measured gas chamber 60 first reaches the pump cell 72.

The measured gas (exhaust gas) includes not only $NO_X$ (NO and $NO_2$), but also oxygen. If the measured gas reaching the sensor cell 71 contains oxygen, current flows to the sensor cell 71 due to the oxygen pumping action. For this reason, if the concentration of oxygen in the measured gas fluctuates, the output of the sensor cell 71 also fluctuates and the precision of detection of the $NO_X$ concentration falls. For this reason, in order to make the concentration of oxygen in the measured gas reaching the sensor cell 71 constant, the oxygen in the measured gas is discharged by the pump cell 72 into the second reference gas chamber 62.

A predetermined voltage is applied to the pump cell 72. As a result, the oxygen in the measured gas becomes oxide ions at the third electrode 83. The oxide ions move through the pump solid electrolyte layer (in the present embodiment, second solid electrolyte layer 89) from the third electrode (cathode) 83 to the fourth electrode (anode) 84 and are discharged into the second reference gas chamber 62 (oxygen pumping action). Therefore, the pump cell 72 can discharge oxygen in the measured gas into the second reference gas chamber 62. Further, current corresponding to the concentration of oxygen in the measured gas flows to the pump cell 72. For this reason, by detecting the output of the pump cell 72, it is possible to detect the concentration of oxygen in the measured gas and in turn detect the air-fuel ratio of the measured gas. Therefore, the pump cell 72 can detect the air-fuel ratio of the outflowing exhaust gas.

Further, if the concentration of oxygen in the measured gas is sufficiently reduced by the pump cell 72, the reaction $2NO_2 \rightarrow 2NO + O_2$ occurs and the $NO_2$ in the measured gas is reduced to NO. Therefore, before the measured gas reaches the sensor cell 71, the $NO_X$ in the measured gas is converted to NO.

The measured gas passing through the pump cell 72 next reaches the monitor cell 73. The monitor cell 73 detects the residual concentration of oxygen in the measured gas. A predetermined voltage is applied to the monitor cell 73. As a result, current corresponding to the concentration of oxygen in the measured gas flows to the monitor cell 73 due to the oxygen pumping action. For this reason, by detecting the output of the monitor cell 73, it is possible to detect the residual concentration of oxygen in the measured gas. The voltage applied to the pump cell 72 is feedback controlled based on the output of the monitor cell 73 so that the residual concentration of oxygen becomes a predetermined low concentration. As a result, the concentration of oxygen in the measured gas reaching the sensor cell 71 is controlled to a certain value.

The measured gas passing through the monitor cell 73 next reaches the sensor cell 71. The sensor cell 71 detects the concentration of $NO_X$ in the measured gas by decomposing the NO in the measured gas. A predetermined voltage is applied to the sensor cell 71. As a result, the NO in the measured gas is decomposed by reduction in the first electrode 81 and oxide ions are produced. The oxide ions move through the sensor solid electrolyte layer (in the present embodiment, first solid electrolyte layer 88) from the first electrode (cathode) 81 to the second electrode (anode) 82 and are discharged into the first reference gas chamber 61. Before the measured gas reaches the sensor cell 71, the $NO_2$ in the measured gas is converted to NO, so current corresponding to the concentration of $NO_X$ (NO and $NO_2$) in the measured gas due to decomposition of NO flows in the sensor cell 71. For this reason, by detecting the output of the sensor cell 71, it is possible to detect the concentration of $NO_X$ in the measured gas. Therefore, the sensor cell 71 can detect the concentration of $NO_X$ in the outflowing exhaust gas.

Note that, if able to remove almost all of the oxygen in the measured gas by the pump cell 72 or if able to make the concentration of oxygen in the measured gas by the pump cell 72 a substantially constant low concentration, it is not necessary to detect the residual concentration of oxygen in the measured gas by the monitor cell 73. For this reason, $NO_X$ sensor 48 may detect the concentration of $NO_X$ in the measured gas by the pump cell 72 and sensor cell 71 without being provided with the monitor cell 73.

Exhaust Purification System of Internal Combustion Engine

An exhaust purification system of an internal combustion engine 100*c* according to a sixth embodiment of the present disclosure, in the same way as the first embodiment, is provided with an upstream side catalyst 20, a downstream side catalyst 24, an ammonia detection device arranged in the exhaust passage at a downstream of the upstream side catalyst 20 in the direction of flow of exhaust, and an air-fuel ratio control part controlling the air-fuel ratio of the inflowing exhaust gas to a target air-fuel ratio. Note that, the exhaust purification system need not be provided with the downstream side catalyst 24.

The sensor cell 71 of the $NO_X$ sensor 48 decompose not only the $NO_X$ in the measured gas, but also the ammonia in the measured gas, since the material forming the first electrode 81 has the function of decomposing ammonia. For this reason, when the outflowing exhaust gas includes ammonia and does not include much $NO_X$ at all, in the sensor cell 71, only a current corresponding to the concentration of ammonia in the outflowing exhaust gas flows due to decomposition of the ammonia. Therefore, the sensor cell 71 can detect the concentration of ammonia in the outflowing exhaust gas.

For this reason, in the sixth embodiment, the sensor cell 71 of the $NO_X$ sensor 48 functions as the ammonia detection device. Further, in the sixth embodiment as well, the control routine for processing for setting the target air-fuel ratio shown in FIG. 9 is performed.

Other Embodiments

Above, embodiments according to the present disclosure were explained, but the present disclosure is not limited to these embodiments and may be modified and changed in various ways within the language of the claims. For example, the upstream side air-fuel ratio sensor 40 may be an oxygen sensor arranged at the upstream side of the upstream side catalyst 20 in the direction of flow of exhaust and detecting that the air-fuel ratio of the inflowing exhaust gas is rich or lean. Similarly, the downstream side air-fuel ratio sensor 41 (air-fuel ratio detection device) may also be an oxygen sensor arranged at the downstream side of the upstream side catalyst 20 in the direction of flow of exhaust and detecting that the air-fuel ratio of the outflowing exhaust gas is rich or lean.

Further, the above-mentioned embodiments may be freely combined. For example, the sixth embodiment may be combined with the second embodiment to fifth embodiment. In this case, as the ammonia detection device, the sensor cell 71 of the $NO_X$ sensor 48 is used. Further, as explained above, the pump cell 72 of the $NO_X$ sensor 48 may detect the air-fuel ratio of the outflowing exhaust gas. For this reason, if the sixth embodiment and the second embodiment or fifth embodiment are combined, as the ammonia detection device and air-fuel ratio detection device, the sensor cell 71 and pump cell 72 of the $NO_X$ sensor 48, or the sensor cell 71 of the $NO_X$ sensor 48 and downstream side air-fuel ratio sensor 41 are used.

Further, in the third embodiment to fifth embodiment, the lean control and the rich control may be alternately performed like in the second embodiment. Further, in the second embodiment or fifth embodiment, the control routine for processing for setting the reference value shown in FIG. 14 may be performed like in the third embodiment. Further, in the second embodiment or fifth embodiment, the control routine for processing for setting a rich set air-fuel ratio shown in FIG. 16 may be performed like in the fourth embodiment.

The invention claimed is:

1. An exhaust purification system of an internal combustion engine comprising:

a catalyst arranged in an exhaust passage of the internal combustion engine and able to store oxygen;

an ammonia detection device arranged in the exhaust passage at a downstream side of the catalyst in a direction of flow of exhaust; and an electronic control unit (ECU) programmed to:

control an air-fuel ratio of inflowing exhaust gas flowing into the catalyst to a target air-fuel ratio, perform rich control making the target air-fuel ratio richer than a stoichiometric air-fuel ratio, and make the target air-fuel ratio leaner than the stoichiometric air-fuel ratio when an output value of the ammonia detection device rises to a variable reference value in the rich control, detect or estimate a temperature of the catalyst or a temperature of exhaust gas flowing out from the catalyst, and make the variable reference value smaller as the detected or estimated temperature of the catalyst or the exhaust gas becomes higher.

2. The exhaust purification system of an internal combustion engine according to claim 1, further comprising an air-fuel ratio detection device arranged in the exhaust passage at the downstream side of the catalyst in the direction of flow of exhaust, wherein in the rich control, if an air-fuel ratio detected by the air-fuel ratio detection device falls to a rich judged air-fuel ratio richer than the stoichiometric air-fuel ratio before the output value of the ammonia detection device rises to the variable reference value, the ECU is programmed to make the target air-fuel ratio leaner than the stoichiometric air-fuel ratio when the air-fuel ratio detected by the air-fuel ratio detection device falls to the rich judged air-fuel ratio.

3. The exhaust purification system of an internal combustion engine according to claim 1, wherein the ECU is programmed to alternately perform lean control making the target air-fuel ratio leaner than the stoichiometric air-fuel ratio and the rich control.

4. The exhaust purification system of an internal combustion engine according to claim 2, wherein the ECU is programmed to alternately perform lean control making the target air-fuel ratio leaner than the stoichiometric air-fuel ratio and the rich control.

5. An exhaust purification system of an internal combustion engine comprising:

a catalyst arranged in an exhaust passage of the internal combustion engine and able to store oxygen;

an ammonia detection device arranged in the exhaust passage at a downstream side of the catalyst in a direction of flow of exhaust;

an electronic control unit (ECU) programmed to control an air-fuel ratio of inflowing exhaust gas flowing into the catalyst to a target air-fuel ratio, and detect or estimate a temperature of the catalyst or a temperature of exhaust gas flowing out from the catalyst, wherein the ECU is programmed to perform rich control making the target air-fuel ratio richer than a stoichiometric air-fuel ratio, and make the target air-fuel ratio leaner than the stoichiometric air-fuel ratio when an output value of the ammonia detection device rises to a variable reference value in the rich control, and the ECU is programmed to make a rich degree of the target air-fuel ratio in the rich control smaller as the detected or estimated temperature of the catalyst or the exhaust gas becomes higher.

6. The exhaust purification system of an internal combustion engine according to claim 1, wherein the ammonia detection device is a sensor cell of an $NO_X$ sensor.

* * * * *